US009931007B2

(12) United States Patent
Morin et al.

(10) Patent No.: US 9,931,007 B2
(45) Date of Patent: Apr. 3, 2018

(54) EVACUATION STATION

(71) Applicant: iRobot Corporation, Bedford, MA (US)

(72) Inventors: Russell Walter Morin, Burlington, MA (US); Faruk Halil Bursal, Lexington, MA (US); Harold Boeschenstein, Boston, MA (US)

(73) Assignee: iRobot Corporation, Bedford, MA (US)

( * ) Notice: Subject to any disclaimer, the term of this patent is extended or adjusted under 35 U.S.C. 154(b) by 258 days.

(21) Appl. No.: 14/944,788

(22) Filed: Nov. 18, 2015

(65) Prior Publication Data

US 2016/0183752 A1 Jun. 30, 2016

Related U.S. Application Data

(60) Provisional application No. 62/096,771, filed on Dec. 24, 2014.

(51) Int. Cl.
*A47L 9/16* (2006.01)
*A47L 9/28* (2006.01)
(Continued)

(52) U.S. Cl.
CPC ..... *A47L 9/1683* (2013.01); *A47L 9/00* (2013.01); *A47L 9/14* (2013.01); *A47L 9/2815* (2013.01);
(Continued)

(58) Field of Classification Search
CPC ..... A47L 9/16839; A47L 9/00; A47L 9/14; A47L 9/2815; A47L 9/2842;
(Continued)

(56) References Cited

U.S. PATENT DOCUMENTS 6,076,226 A * 6/2000 Reed ..... A47L 5/28 15/319
6,748,297 B2 * 6/2004 Song ..... A47L 9/2805 15/319
(Continued)

FOREIGN PATENT DOCUMENTS

WO 2016105702 9/2003

OTHER PUBLICATIONS

International Preliminary Report on Patentability in international Application No. PCT/US2015/061341 dated Jun. 27, 2017, 8 pages.
(Continued)

*Primary Examiner* — Dung Van Nguyen
(74) *Attorney, Agent, or Firm* — Fish & Richardson P.C.

(57) ABSTRACT

An evacuation station includes a base and a canister removably attached to the base. The base includes a ramp having an inclined surface for receiving a robotic cleaner having a debris bin. The ramp defines an evacuation intake opening arranged to pneumatically interface with the debris bin. The base also includes a first conduit portion pneumatically connected to the evacuation intake opening, an air mover having an inlet and an exhaust, and a particle filter pneumatically the exhaust of the air mover. The canister includes a second conduit portion arranged to pneumatically interface with the first conduit portion to form a pneumatic debris intake conduit, an exhaust conduit arranged to pneumatically connect to the inlet of the air mover when the canister is attached to the base, and a separator in pneumatic communication with the second conduit portion.

14 Claims, 15 Drawing Sheets

(51) Int. Cl.
*A47L 9/14* (2006.01)
*A47L 9/00* (2006.01)

(52) U.S. Cl.
CPC ..... *A47L 9/2842* (2013.01); *A47L 9/2857* (2013.01); *A47L 9/2873* (2013.01); *A47L 2201/024* (2013.01); *A47L 2201/04* (2013.01)

(58) Field of Classification Search
CPC ..... A47L 9/2857; A47L 9/2873; A47L 2201/024; A47L 2201/04
See application file for complete search history.

(56) References Cited

U.S. PATENT DOCUMENTS

| | | | | |
|---|---|---|---|---|
| 9,027,199 | B2 * | 5/2015 | Jung | A47L 9/106 15/346 |
| 2005/0150519 | A1 * | 7/2005 | Keppler | A47L 5/38 134/19 |
| 2008/0140255 | A1 | 6/2008 | Ziegler et al. | |
| 2009/0049640 | A1 * | 2/2009 | Lee | A47L 9/20 15/319 |
| 2012/0011676 | A1 | 1/2012 | Jung et al. | |
| 2012/0291809 | A1 | 11/2012 | Kuhe et al. | |
| 2013/0305483 | A1 | 11/2013 | Dyson et al. | |

OTHER PUBLICATIONS

International Search Report and Written Opinion for related PCT Application No. PCT/US2015/061341 dated Mar. 11, 2016.

* cited by examiner

EVACUATION STATION

CROSS REFERENCE TO RELATED APPLICATION

This U.S. patent application claims priority under 35 U.S.C. § 119(e) to U.S. Provisional Application 62/096,771, filed Dec. 24, 2014, which is hereby incorporated by reference in its entirety.

TECHNICAL FIELD

This disclosure relates to evacuating debris collected by robotic cleaners.

BACKGROUND

Autonomous robots are robots which can perform desired tasks in unstructured environments without continuous human guidance. Many kinds of robots are autonomous to some degree. Different robots can be autonomous in different ways. An autonomous robotic cleaner traverses a work surface without continuous human guidance to perform one or more tasks. In the field of home, office, and/or consumer-oriented robotics, mobile robots that perform household functions, such as vacuum cleaning, floor washing, lawn cutting and other such tasks, have become commercially available.

SUMMARY

A robotic cleaner may autonomously move across a floor surface of an environment to collect debris, such as dirt, dust, and hair, and store the collected debris in a debris bin of the robotic cleaner. The robotic cleaner may dock with an evacuation station to evacuate the collected debris from the debris bin and/or to charge a battery of the robotic cleaner. The evacuation station may include a base that receives the robotic cleaner in a docked position. While in the docked position, the evacuation station interfaces with the debris bin of the robotic cleaner so that the evacuation station can remove debris accumulated within the debris bin. The evacuation station may operate in one of two modes, an evacuation mode and an air filtration mode. During the evacuation mode, the evacuation station removes debris from the debris bin of a docked robotic cleaner. During the air filter filtration, the evacuation station filters air about the evacuation station, regardless of whether the robotic cleaner is docked at the evacuation station. The evacuation station may pass an air flow through a particle filter to remove small particles (e.g., ~0.1 to ~0.5 micrometers) before exhausting to the environment. The evacuation station may operate in the air filtration mode when the evacuation is not evacuating debris from the debris bin. For example, the air filtration mode may operate when a canister for collecting debris is not connected to the base, when the robotic cleaner is not docked with the evacuation station, or whenever debris is not being evacuated from the robotic cleaner.

One aspect of this disclosure provides an evacuation station including a base and a canister. The base includes a ramp, a first conduit portion of a pneumatic debris intake conduit, an air mover, and a particle filter. The ramp has a receiving surface for receiving and supporting a robotic cleaner having a debris bin. The ramp defines an evacuation intake opening arranged to pneumatically interface with the debris bin of the robotic cleaner when the robotic cleaner is received on the receiving surface in a docked position. The first conduit portion of the pneumatic debris conduit is pneumatically connected to the evacuation intake opening. The air mover has an inlet and an exhaust, with the air mover moving air received from the inlet out the exhaust. The particle filter is pneumatically connected to the exhaust of the air mover. The canister is removably attached to the base and includes a second conduit portion of the pneumatic debris intake conduit, a separator, an exhaust conduit and a collection bin. The second conduit portion is arranged to pneumatically connect to or interface with the first conduit portion to form the pneumatic debris intake conduit (e.g., as a single conduit) when the canister is attached to the base. The separator is in pneumatic communication with the second conduit portion of the debris intake conduit, with the separator separating debris out of a received flow of air. The exhaust conduit is in pneumatic communication with the separator and arranged to pneumatically connect to the inlet of the air mover when the canister is attached to the base. The collection bin is in pneumatic communication with the separator.

Implementations of the disclosure may include one or more of the following optional features. In some implementations, the separator defines at least one collision wall and channels arranged to direct the flow of air from the second conduit portion of the pneumatic debris intake conduit toward the at least one collision wall to separate debris out of the flow of air. At least one collision wall may define a separator bin having a substantially cylindrical shape.

In some examples, the separator includes an annular filter wall defining an open center region. The annular filter wall is arranged to receive the flow of air from the second conduit portion of the pneumatic debris intake conduit to remove debris out of the flow of air. The separator may include another particle filter filtering larger particles than the other particle filter. The separator may further include a filter bag arranged to receive the flow of air from the second conduit portion of the pneumatic debris intake conduit to remove debris out of the flow of air.

In some implementations, the collection bin includes a debris ejection door movable between a closed position for collecting debris in the collection bin and an open position for ejecting collected debris from the collection bin. The canister and the base may have a trapezoidal shaped cross section. The canister and the base may define a height of the evacuation station, the canister defining greater than half of the height of the evacuation station. Additionally or alternatively, the canister defines at least two-thirds of the height of the evacuation station.

In some examples, the ramp further includes a seal pneumatically sealing the evacuation intake opening and a collection opening of the robotic cleaner when the robotic cleaner is in the docked position. The ramp may further include one or more charging contacts disposed on the receiving surface and arranged to interface with one or more corresponding electrical contacts of the robotic cleaner when received in the docked position. The ramp may further include one or more alignment features disposed on the receiving surface and arranged to orient the received robotic cleaner so that the evacuation intake opening pneumatically interfaces with the debris bin of the robotic cleaner and the one or more charging contacts electrically connect to the electrical contacts of the robotic cleaner when received in the docked position. Additionally or alternatively, one or more alignment features may include wheel ramps accepting wheels of the robotic cleaner while the robotic cleaner is moving to the docked position and wheel cradles supporting the wheels of the robotic cleaner when the robotic cleaner is in the docked position.

The evacuation station may further include a controller in communication with the air mover and the one or more charging contacts. The controller may activate the air mover to move air when the controller receives an indication of electrical connection between the one or more charging contacts and the one or more corresponding electrical contacts.

Another aspect of the disclosure includes a base and a canister. The base includes a ramp, a first conduit portion of a pneumatic debris intake conduit, a flow control device, an air mover, and a particle filter. The ramp has a receiving surface for receiving and supporting a robotic cleaner having a debris bin. The ramp defines an evacuation intake opening arranged to pneumatically interface with the debris bin of the robotic cleaner when the robotic cleaner is received on the receiving surface in a docked position. The first conduit portion of the pneumatic debris intake conduit is pneumatically connected to the evacuation intake opening and the flow control device is pneumatically connected to the first conduit portion of the pneumatic debris intake conduit. The air mover has an inlet and an exhaust. The inlet is pneumatically connected to the flow control device. The air mover moves air received from the inlet or the flow control device out the exhaust. The particle filter is pneumatically connected to the exhaust. The canister is removable attached to the base and includes a second conduit portion of the pneumatic debris intake conduit, a separator, an exhaust conduit and a collection bin. The second conduit portion is arranged to pneumatically connect to or interface with the first conduit portion to form the pneumatic debris intake conduit when the canister is attached to the base. The separator is in pneumatic communication with the second conduit portion of the pneumatic debris intake conduit. The separator separates debris out of a received flow of air. The exhaust conduit is in pneumatic communication with the separator and arranged to pneumatically connect to the inlet of the air mover when the canister is attached to the base. The collection bin is in pneumatic communication with the separator.

In some implementations, the flow control device moves between a first position that pneumatically connects the exhaust to the inlet of the air mover when the canister is attached to the base and a second position that pneumatically connects an environmental air inlet of the air mover to the exhaust of the air mover. Additionally or alternatively, the flow control device moves to the second position, pneumatically connecting the exhaust to the inlet of the air mover, when the canister is removed from the base. The flow control device may be spring biased toward the first position or the second position.

In some examples, the evacuation station further includes a controller in communication with the flow control device and the air mover. The controller executes operation modes including a first operation mode and a second operation mode. During the first operation mode, the controller activates the air mover and actuates the flow control device to move to the first position, pneumatically connecting the exhaust to the inlet of the air mover. During the second operation mode, the controller activates the air mover and actuates the flow control device to the second position, pneumatically connecting the environmental air inlet of the air mover to the exhaust of the air mover.

The evacuation station may further include a connection sensor in communication with the controller and sensing connection of the canister to the base. The controller executes the first operation mode when the controller receives a first indication from the connection sensor indicating that the canister is connected to the base. The controller executes the second operation mode when the controller receives a second indication from the connection sensor indicating that the canister is disconnected from the base.

The evacuation station may further include one or more charging contacts in communication with the controller, disposed on the receiving surface of the ramp, and arranged to interface with one or more corresponding electrical contacts of the robotic cleaner when received in the docked position. When the controller receives an indication of electrical connection between the one or more charging contacts and the one or more corresponding electrical contacts it executes the first operation mode. Additionally or alternatively, when the controller receives an indication of electrical disconnection between the one or more charging contacts and the one or more corresponding electrical contacts, it executes the second operation mode.

In some examples, the ramp further includes one or more alignment features disposed on the receiving surface and is arranged to orient the received robotic cleaner so that the evacuation intake opening pneumatically interfaces with the debris bin of the robotic cleaner and the one or more charging contacts electrically connected to the electrical contacts of the robotic cleaner when received in the docket position. Additionally or alternatively, the one or more alignment features may include wheel ramps accepting wheels of the robotic cleaner while the robotic cleaner is moving to the docked position and wheel cradles supporting the wheels of the robotic cleaner when the robotic cleaner is in the docked position.

In some examples, the separator defines at least one collision wall and channels arranged to direct the flow of air from the second conduit portion of the pneumatic debris intake conduit toward the at least one collision wall to separate debris out of the flow of air. At least one collision wall may define a separator bin having a substantially cylindrical shape.

In some implementations, the separator includes an annular filter wall defining an open center region. The annular filter wall is arranged to receive the flow of air from the second conduit portion of the pneumatic debris intake conduit to remove the debris out of the flow of air. The separator may include another particle filter filtering larger particles than the other particle filter. The separator may further include a filter bag arranged to receive the flow of air from the second conduit portion of the pneumatic debris intake conduit to remove debris out of the flow of air. In some examples, the collection bin includes a debris ejection door movable between a closed position for collecting debris in the collection bin and an open position for ejecting collected debris from the collection bin. The canister and the base may have a trapezoidal shaped cross section. The canister and the base may define a height of the evacuation station, the canister defining greater than half of the height of the evacuation station. Additionally or alternatively, the canister defines at least two-thirds of the height of the evacuation station. In some examples, the ramp further includes a seal pneumatically sealing the evacuation intake opening and a collection opening of the robotic cleaner when the robotic cleaner is in the docked position.

Yet another aspect of the disclosure provides a method that includes receiving, at a computing device, a first indication of whether a robotic cleaner is received on a receiving surface of an evacuation station in a docked position. The method further includes receiving, at the computing device, a second indication of whether a canister of the evacuation station is connected to a base of the evacuation station. When the first indication indicates that the robotic cleaner is received on the receiving surface of the evacuation station in the docked position and the second indication indicates that the canister is connected to the base, the method includes actuating a flow control valve, using the computing device, to move to a first position that pneumatically connects exhaust conduit of the canister or base to an inlet of an air mover of the canister or base and activating, using the computing device, the air mover to draw air into an evacuation intake opening defined by the evacuation station pneumatically interfacing with a debris bin of the robotic cleaner to draw debris from the debris bin of the docked robotic cleaner into the canister. When the first indication indicates that the robotic cleaner is not received on the receiving surface of the evacuation station in the docked position or the second indication indicates that the canister is disconnected from the base, the method includes actuating the flow control valve, using the computing device, to move to a second position that pneumatically connects an environmental air inlet of the air mover to a particle filter and activating, using the computing device, the air mover to draw air into the environmental air inlet and move the drawn air through the particle filter.

In some examples, the method includes receiving the first indication including receiving an electrical signal from one or more changing contacts disposed on the receiving surface and arranged to interface with one or more corresponding electrical contacts of the robotic cleaner when the robotic cleaner is received in the docked position. Receiving the second indication includes receiving a signal from a connection sensor sensing connection of the canister to the base. Additionally or alternatively, the connection sensor includes an optical-interrupt sensor, a contact sensor, and/or a switch.

In some implementations, the base includes a first conduit portion of a pneumatic debris intake conduit pneumatically connected to the evacuation intake opening. The air mover has an inlet and an exhaust, the inlet is pneumatically connected to the flow control valve and the air mover moves air received from the inlet or the flow control valve out the exhaust. The particle filter is pneumatically connected to the exhaust.

In some examples, the canister includes a second conduit portion of the pneumatic debris intake conduit arranged to pneumatically connect to the first conduit portion to form the pneumatic debris intake conduit when the canister is attached to the base. The separator is in pneumatic communication with the second conduit portion, the separator separating debris out of a received flow of air. The exhaust is in pneumatic communication with the separator and arranged to pneumatically connect to the inlet of the air mover when the canister is attached to the base and when the flow control valve is in the first position. The collection bin is in pneumatic communication with the separator.

Yet another aspect of the disclosure provides a method that includes receiving a robotic cleaner on a receiving surface. The receiving surface defines an evacuation intake opening arranged to pneumatically interface with a debris bin of the robotic cleaner when the robotic cleaner is received in a docked position. The method includes drawing a flow of air from the debris bin through a pneumatic debris intake conduit using an air mover. The method further includes directing the flow of air to a separator in communication with the pneumatic debris intake conduit. The separator is defined by at least one collision wall and channels arranged to direct the flow of air from the pneumatic debris intake conduit toward the at least one collision wall to separate debris out of the flow of air. The method further includes collecting the debris separated by the separator in a collection bin in communication with the separator.

In some implementations, the method further includes receiving a first indication of whether the robotic cleaner is received on the receiving surface in the docked position and receiving a second indication of whether the canister is connected to the base. When the first indication indicates that the robotic cleaner is received on the receiving surface in the docked position and the second indication indicates that the canister is connected to the base, the method further includes drawing the flow of air from the debris bin and directing the flow of air to the separator.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
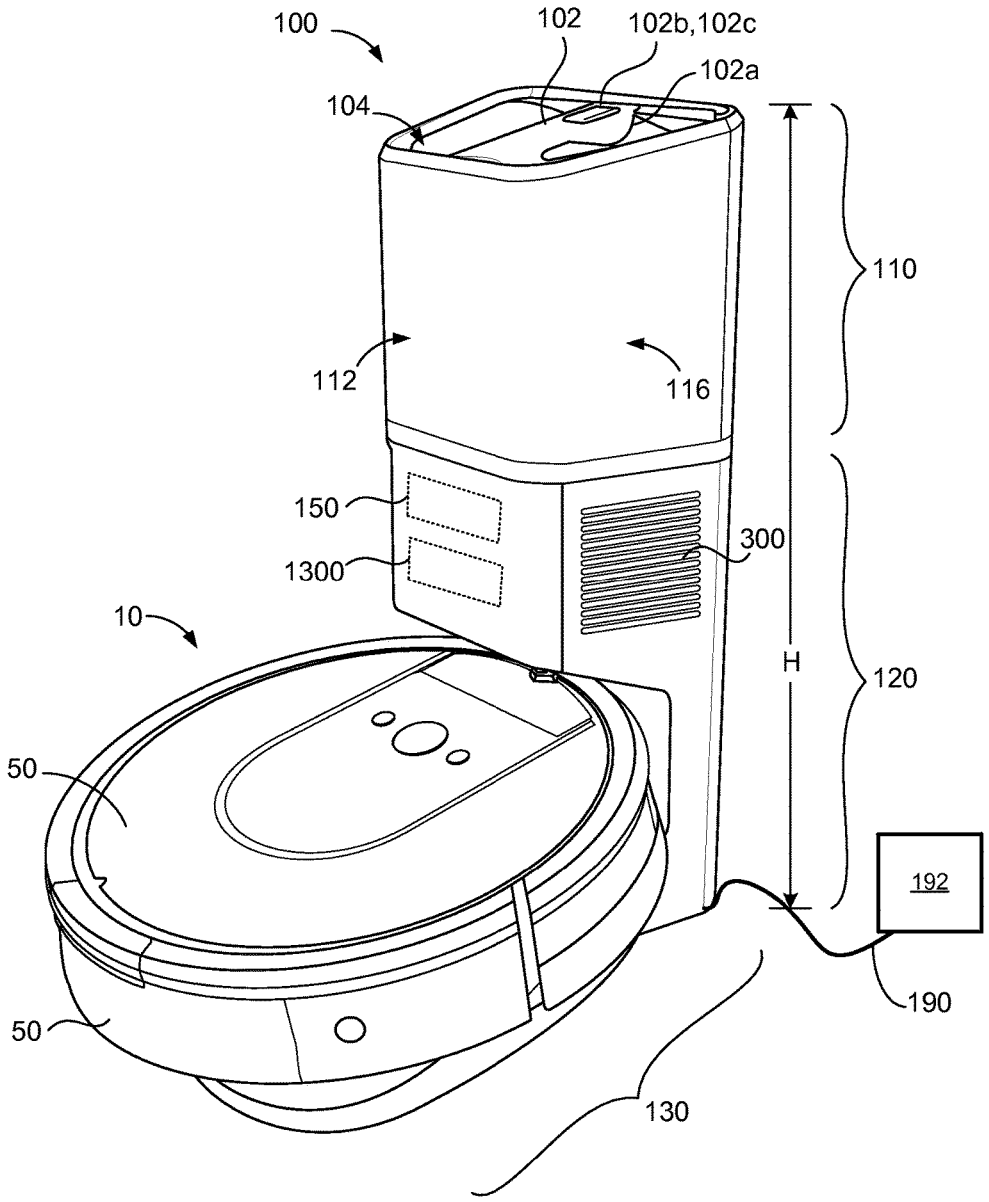
FIG. 1 shows a perspective view of an example robotic cleaner docked with an evacuation station.
Figure 2A:
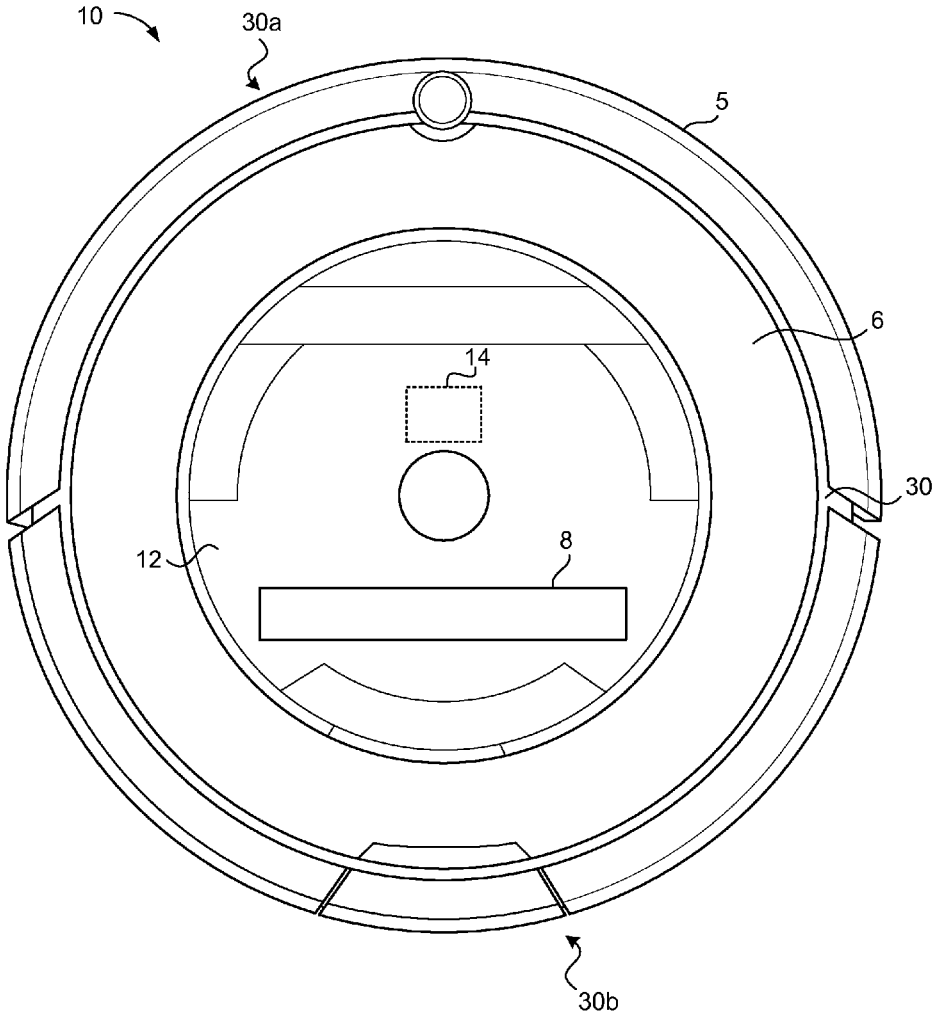
FIG. 2A is top view of an example robotic cleaner.
Figure 2B:
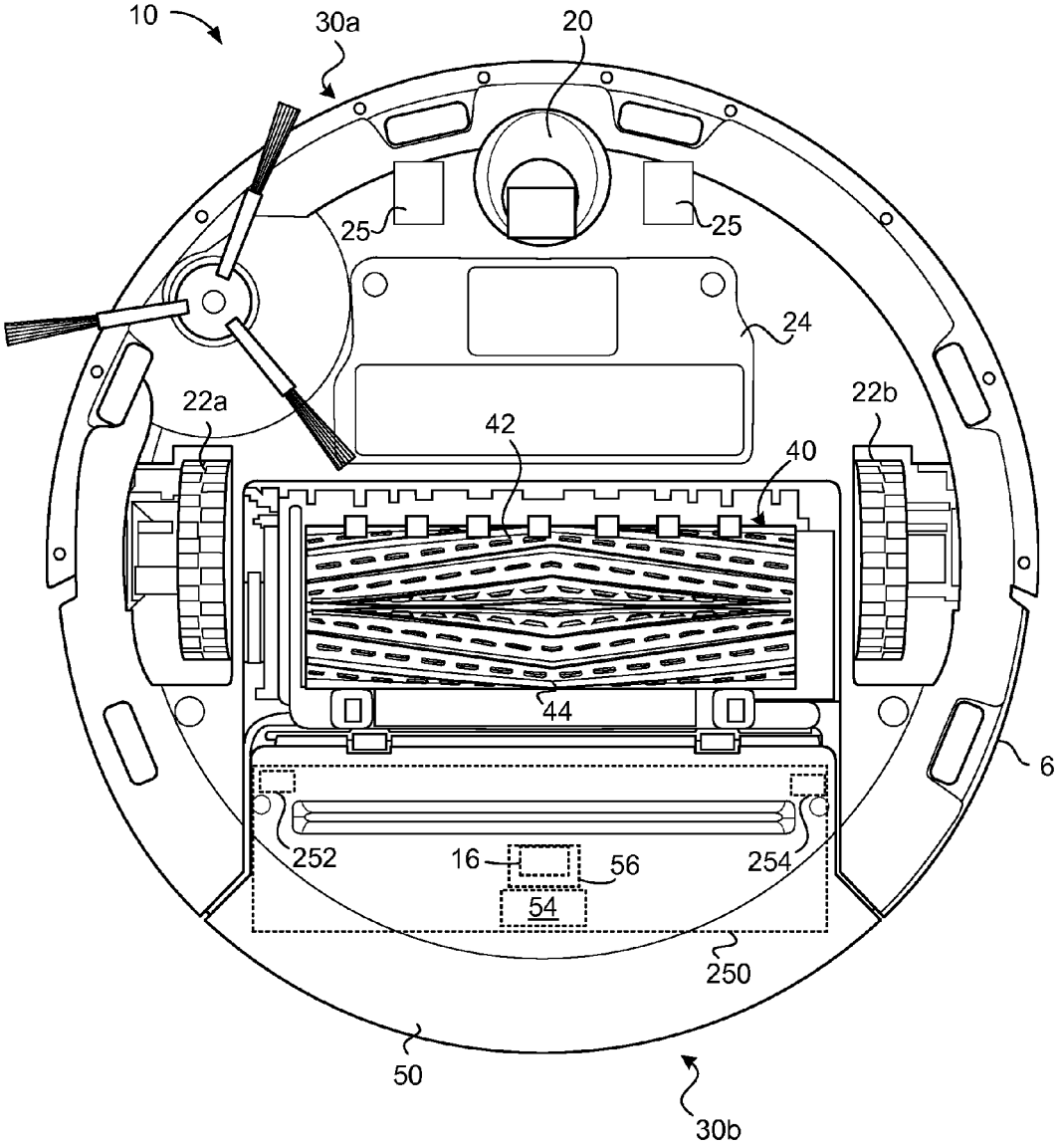
FIG. 2B is a bottom view of an example robotic cleaner.
Figure 3:
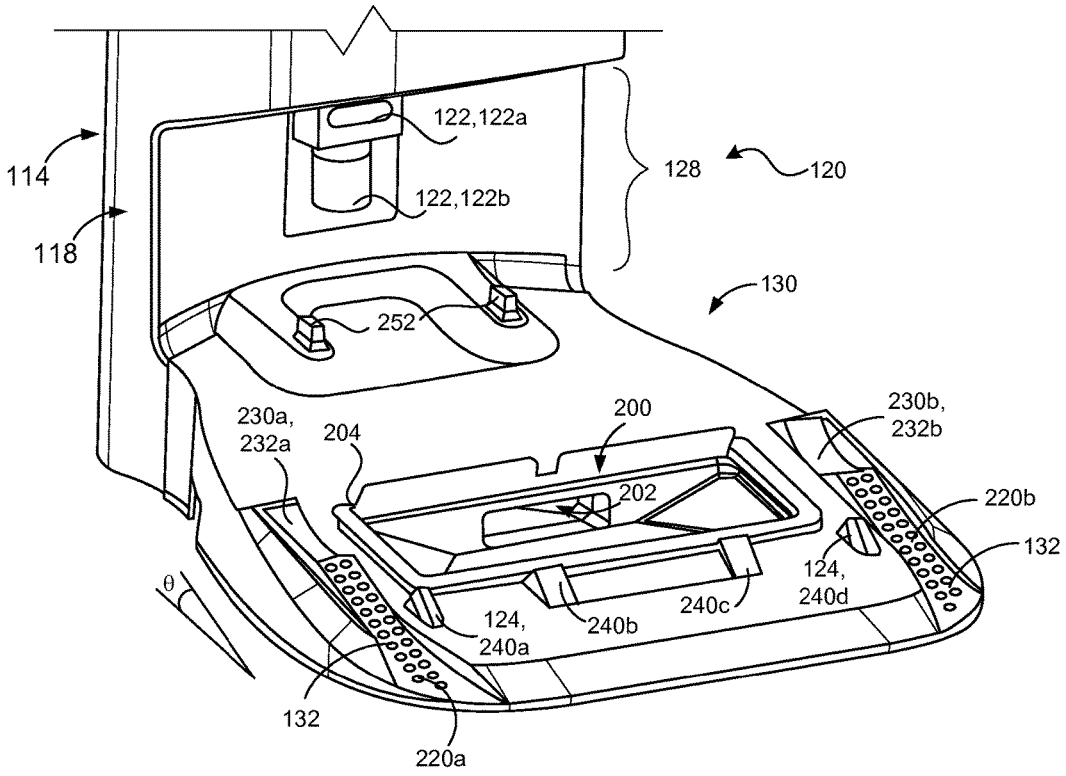
FIG. 3 is a perspective view of an example ramp and base of an evacuation station.

Referring to FIGS. 1-5, in some implementations, an evacuation station 100 for evacuating debris collected by a robotic cleaner 10 includes a base 120 and a canister 110 removably attached to the base 120. The base 120 includes a ramp 130 having a receiving surface 132 (FIG. 3) for receiving and supporting a robotic cleaner 10 having a debris bin 50. As shown in FIG. 3, the ramp 130 defines an evacuation intake opening 200 arranged to pneumatically interface with the debris bin 50 of the robotic cleaner 10 when robotic cleaner 10 is received on the receiving surface 132 in a docked position. The docked position refers to the receiving surface 132 in contact with and supporting wheels 22*a*, 22*b* of the robotic cleaner 10. In some implementations, the ramp 130 is included at an angle, θ. When the robotic cleaner 10 is in the docked position, the evacuation station 100 may remove debris from the debris bin 50 of the robotic cleaner 10. In some implementations, the evacuation station 100 charges one or more energy storage devices (e.g., a battery 24) of the robotic cleaner 10 while in the docked position. In some examples, the evacuation station 100 simultaneously removes debris from the bin 50 while charging the battery 24 of the robot 10.

A lower portion 128 of the base 120 proximate to the ramp 130 may include a profile having a radius configured to permit the robot 10 to be received and supported upon the ramp 130. External surfaces of the canister 110 and the base 120 may be defined by front and back walls 112, 114 and first and second side walls 116, 118. In some examples, the walls 112, 114, 116, 118 define a trapezoidal shaped cross section of the canister 110 and the base 120 to enable the back wall 114 of the canister 110 and the base 120 to unobtrusively abut and rest flush against a wall in the environment. When the walls 112, 114, 116, 118 define the trapezoidal shaped cross section, the back wall 114 may include a width (i.e., distance between the side walls 116 and 118) greater than a width of the front wall 112. In other examples, the cross section of the canister 110 and the base 120 may be polygonal, rectangular, circular, elliptical or some other shape.

Figure 4:
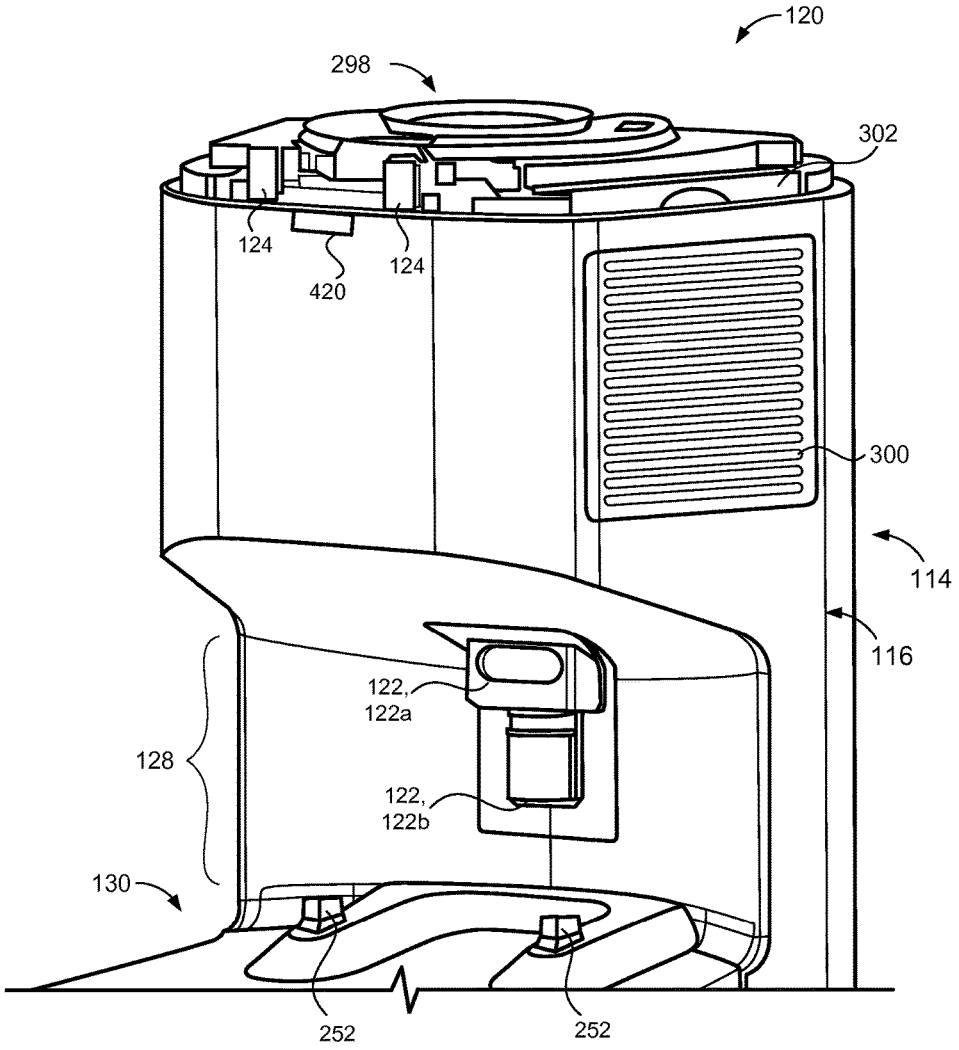
FIG. 4 is a perspective view of an example base of an evacuation station.

In some examples, the base 120 and the ramp 130 of the evacuation station 100 are integral, while the canister 110 is removably attached to the base 120 (e.g., via one or more latches 124, as shown in FIG. 4) to collect debris drawn from the debris bin 50 when the robot 10 is in the docked position at the evacuation station 100. In some examples, the one or more latches 124 releasably engage with corresponding spring-loaded detents 125 (FIG. 6) located on the canister 110. The canister 110 and the base 120 together define a height H of the evacuation station 100. In some examples, the canister 110 includes greater than half of the defined height H. In other examples, the canister 110 includes at least two-thirds of the defined height H. The canister 110 may attach to the base 120 when a user applies sufficient force, causing features located on the canister 110 to engage with the latches 124 disposed on the base 120. A connection sensor 420 (FIG. 4) may communicate with a controller 1300 (e.g., computing device) and sense connection of the canister 110 to the base 120. In some examples, the connection sensor 420 includes a contact sensor (e.g., a switch or a capacitive sensor) sensing whether or not a mechanical connection exists between the one or more latches 124 and corresponding spring-loaded detents 125 located on the canister 110. In other examples, the connection sensor 420 includes an optical sensor (e.g., photointerrupter/phototransistor or infrared proximity sensor) sensing whether or not the canister 110 is connected to the base 120. The canister 110 may be removed or detached from the base 120 when a user pulls the canister 110 away from the base 120 releasing the latches 124. The canister 110 may include a handle 102 for a user to grip to transport the canister 110. In some examples, the canister 110 detaches from the base 120 when a user pulls upward on the handle 102. In some examples, the canister 110 includes an actuator button 102*c* for releasing the latches 124 of the base 120 from the corresponding spring-loaded detents 125 located on the canister 110 when the user depresses the actuator button 102*c*.

In some implementations, the canister 110 includes a debris ejection door button 102*a* for opening a debris ejection door 662 (FIG. 6) when a user presses the button 102*a* to empty debris into a trash receptacle when the canister 110 is full. In some implementations, the canister 110 includes a filter access door button 102*b* for opening a filter access door 104 of the canister 110 when the button 102*b* depresses to access a filter 650 (FIG. 6) or filter bag 1050 (FIG. 10) for inspection, servicing, and/or replacement. Ergonomically, the buttons 102*a*, 102*b*, 102*c* may be located on or proximate to the handle 102.

The evacuation station 100 may be powered by an external power source 192 via a power cord 190. For example, the external power source 192 may include a wall outlet, delivering an alternating current (AC) via the power cord 190 for powering an air mover 126 (FIG. 5) that causes debris to be pulled from the debris bin 50 of the robotic cleaner 10. The evacuation station 100 may include a DC converter 1790 (FIG. 17) for powering the controller 1300 of the evacuation station 100.

In some implementations, the controller 1300 receives signals and executes algorithms to determine whether or not the robotic cleaner 10 is in the docked position at the evacuation station 100. For example, the controller 1300 may detect the location of the robot 10 in relation to the evacuation station 100 (via one or more sensors, such as proximity and/or contact sensors) to determine whether the robotic cleaner 10 is in the docked position. The controller 1300 may operate the evacuation station 100 in an evacuation mode (e.g., first operation mode) to suck and collect debris from the debris bin 50 of the robotic cleaner 10. When the robotic cleaner 10 is not in the docked position or the evacuation station 100 is not operating in the evacuation mode while the robotic cleaner 10 is in the docked position, the controller 1300 may operate the evacuation station 100 in an air filtration mode (e.g., second operation mode). During the air filtration mode, environmental air is drawn by the air mover 126 into the base 120 of the evacuation station 100 and filtered before being released to the environment. For instance, during the evacuation mode, environmental air may be drawn by the air mover 126 through an inlet 298 (FIG. 5) of the base 120 and filtered by a particle filter 302 (FIG. 5) within the base 120 and out an exhaust 300. The base 120 may further include a user interface 150 in communication with the controller 1300 for allowing the user to input signals for execution by the evacuation station and for displaying operation and functionality of the evacuation station 100. For example, the user interface 150 may display a current capacity of the canister 110, a remaining time for the debris bin 50 to be evacuated, a remaining time for the robot 10 to be charged, a confirmation of the robot 10 being docked, or any other pertinent parameter. In some examples, the user interface 150 and/or controller 1300 are located on the front wall 112 of the canister 110 for improved accessibility and visibility.

FIGS. 2A and 2B illustrate an exemplary autonomous robotic cleaner 10 (also referred to as a robot) for docking with the evacuation station; however, other types of robotic cleaners are possible as well, with different components and/or different arrangements of components. In some implementations, the autonomous robotic cleaner 10 includes a chassis 30 which carries an outer shell 6. FIG. 2A shows the outer shell 6 of the robot 10 connected to a front bumper 5. The robot 10 may move in forward and reverse drive directions; consequentially, the chassis 30 has corresponding forward and back ends 30*a*, 30*b*, respectively. The forward end 30*a* is fore in the direction of primary mobility and the direction of the bumper 5. The robot 10 typically moves in the reverse direction primarily during escape, bounces, and obstacle avoidance. A collection opening 40 is located toward the middle of the robot 10 and installed within the chassis 30. The collection opening 40 includes a first debris extractor 42 and a parallel second debris extractor 44. In some examples, the first debris extractor 42 and/or the parallel second debris extractor 44 is/are removable. In other examples, the collection opening 40 includes a fixed first debris extractor 42 and/or a parallel second debris extractor 44, where fixed refers to an extractor installed on and coupled to the chassis 30, yet removable for routine maintenance. In some implementations, the debris extractors 42 and 44 are composed of rubber and include flaps or vanes for collecting debris from the cleaning surface. In some examples, the debris extractors 42 and/or 44 are brushes that may be a pliable multi-vane beater or have pliable beater flaps between rows of brush bristles.

The battery 24 may be housed within the chassis 30 proximate the collection opening 40. Electrical contacts 25 are electrically connected to the battery 24 for providing charging current and/or voltage to the battery 24 when the robot 10 is in the docked position and is undergoing a charging event. For example, the electrical contacts 25 may contact associated charging contacts 252 (FIG. 3) located on the ramp 130 of the evacuation station 100.

Installed along either side of the chassis 30 are differentially driven left and right wheels 22*a*, 22*b* that mobilize the robot 10 and provide two points of support. The forward end 30*a* of the chassis 30 includes a caster wheel 20 which provides additional support for the robot 10 as a third point of contact with the floor (cleaning surface) and does not hinder robot mobility. The removable debris bin 50 is located toward the back end 30*b* of the robot 10 and installed within or forms part of the outer shell 6.

In some implementations, as shown in FIG. 2A the robot 10 includes a display 8 and control panel 12 located upon the outer shell 6. The display 8 may display an operational mode of the robot 10, debris capacity of the debris bin 50, state of charge of the battery 24, remaining life of the battery 24, or any other parameters. The control panel 12 may receive inputs from a user to turn on/off the robot 10, schedule charging events for the battery 24, select evacuation parameters for evacuating the debris bin 50 at the evacuation station 100, or select a mode of operation for the robot 10. The control panel 12 may be in communication with a microprocessor 14 that executes one or more algorithms (e.g., cleaning routines) based upon the user inputs to the control panel 12.

Referring again to FIG. 2B, the bin 50 may include a bin-full detection system 250 for sensing an amount of debris present in the bin 50. The bin-full detection system 250 includes an emitter 252 and a detector 254 housed in the bin 50. The emitter 252 transmits light and the detector 254 receives reflected light. In some implementations, the bin 50 includes a microprocessor 54, which may be connected to the emitter 252 and the detector 254, respectively, to execute an algorithm to determine whether the bin 50 is full. The microprocessor 54 may communicate with the battery 24 and the microprocessor 14 of the robot 10. The microprocessor 54 may communicate with the robotic cleaner 10 from a bin serial port 56 to a robot serial port 16. The robot serial port 16 may be in communication with the microprocessor 14. The serial ports 16, 56 may be, for example, mechanical terminals or optical devices. For instance, the microprocessor 54 may report bin full events to the microprocessor 14 of the robotic cleaner 10. Likewise, the microprocessors 14, 54 may communicate with the controller 1300 to report signals when the robotic cleaner 10 has docked at the ramp 130 of the evacuation station 100.

Referring to FIG. 3, the ramp 130 of the evacuation station 100 may include a receiving surface 132 (having an inclination angle θ with respect to the supporting ground surface) selected for facilitating access to and removal of debris residing in the debris bin 50. The inclination angle θ may also cause debris residing in the debris bin 50 to gather at the back of the bin 50 (due to gravity) when the robot 10 is received in the docked position. In the example shown, the robot 10 docks with the forward end 30*a* facing the evacuation station 100; however other docking orientations or poses are possible as well. In some examples, the ramp 130 includes one or more charging contacts 252 disposed on the receiving surface 132 and arranged to interface with one or more corresponding electrical contacts 25 of the robotic cleaner 10 when received in the docked position. In some examples, the controller 1300 determines the robot 10 is in the docked position when the controller receives a signal indicating the charging contacts 252 are connected to the electrical contacts 25 of the robot 10. The charging contacts 252 may include pins, strips, plates, or other elements sufficient for conducting electrical charge. In some examples, the charging contacts 252 may guide the robotic cleaner 10 (e.g., indicate when the robotic cleaner 10 is docked).

In some implementations, the ramp 130 includes one or more guide alignment features 240*a-d* disposed on the receiving surface 132 and arranged to orient the received robotic cleaner so that the evacuation intake opening 200 pneumatically interfaces with the debris bin 50 of the robotic cleaner 10. The guide alignment features 240*a-d* may additionally be arranged to orient the received robotic cleaner so the one or more charging contacts 252 electrically connect to the electrical contacts 25 of the robotic cleaner 10. In some examples, the ramp 130 includes wheel ramps 220*a*, 220*b* accepting wheels 22*a*, 22*b* of the robotic cleaner 10 while the robotic cleaner 10 is moving to the docked position. For example, a left wheel ramp 220*a* accepts the left wheel 22*a* of the robot 10 and a right wheel ramp 220*b* accepts the right wheel 22*b* of the robot 10. Each wheel ramp 220*a*, 220*b* may include an inclined surface and a pair of corresponding side walls defining a width of each wheel ramp 220*a*, 220*b* for retaining and aligning the wheels 22*a*, 22*b* of the robotic cleaner 10 upon the wheel ramps 220*a*, 220*b*. Accordingly, the wheel ramps 220*a*, 220*b* may include a width slightly greater than a width of the wheels 22*a*, 22*b* and may include one or more traction features for reducing slippage between the wheels 22*a*, 22*b* of the robotic cleaner 10 and the wheel ramps 220*a*, 220*b* when the robotic cleaner 10 is moving to the docked position. In some examples, the wheel ramps 220*a*, 220*b* further function as guide alignment features for aligning the robot 10 when docking on the ramp 130.

In some examples, the one or more guide alignment features include wheel cradles 230*a*, 230*b* supporting the wheels 22*a*, 22*b* of the robotic cleaner 10 when the robotic cleaner 10 is in the docked position. The wheel cradles 230*a*, 230*b* serve to support and stabilize the wheels 22*a*, 22*b* when the robotic cleaner 10 is in the docked position. In the example shown, the wheel cradles 230*a*, 230*b* include U-shaped depressions upon the ramp 130 having radii large enough to accept and retain the wheels 22*a*, 22*b* after the wheels 22*a*, 22*b* traverse the wheel ramps 220*a*, 220*b*. In some examples, the wheel cradles 230*a*, 230*b* are rectangular shaped, V-shaped or other shaped depressions. Surfaces of the wheel cradles 230*a*, 230*b* may include a texture permitting slippage of the wheels 22*a*, 22*b* such that the wheels 22*a*, 22*b* can be rotationally aligned when at least one of the wheel cradles 230*a*, 230*b* accepts a corresponding wheel 22*a*, 22*b*. The cradles 230*a*, 230*b* may include sensors (or features) 232*a*, 232*b*, respectively, indicating when the robotic cleaner 10 is in the docked position. The cradle sensors 232*a*, 232*b* may communicate with the controller 1300, 14 and/or 56 to determine when evacuation and/or charging events can occur. In some examples, the cradle sensors 232*a*, 232*b* include weight sensors that measure a weight of the robotic cleaner 10 when received in the docked position. The features 232*a*, 232*b* may include biasing features that depress when the wheels 22*a*, 22*b* of the robot 10 are received by the cradles 230*a*, 230*b*, causing a signal to be transmitted to the controller 1300, 14 and/or 54 that indicates the robot 10 is in the docked position.

In the example shown in FIG. 3, the evacuation intake opening 200 is arranged to interface with the collection opening 40 of the robotic cleaner 10. For example, the evacuation intake opening 200 is arranged to pneumatically interface with the debris bin 50 via the collection opening 40 so that an air flow caused by the air mover 126 draws the debris out of the debris bin 50 and through the collection and evacuation intake openings 40, 200, respectively, to a first conduit portion 202*a* of a pneumatic debris intake conduit 202 (FIG. 5) of the evacuation station 100. In some implementations, the ramp 130 also includes a seal 204 pneumatically sealing the evacuation intake opening 200 and the collection opening 40 of the robotic cleaner 10 when the robotic cleaner 10 is in the docked position. The drawn flow of air may or may not cause the primary and parallel secondary debris extractors 42, 44, respectively, to rotate as the debris are drawn through the collection opening 40 of the robotic cleaner 10 and into the evacuation intake opening 200 of the ramp 130.

Figure 5:
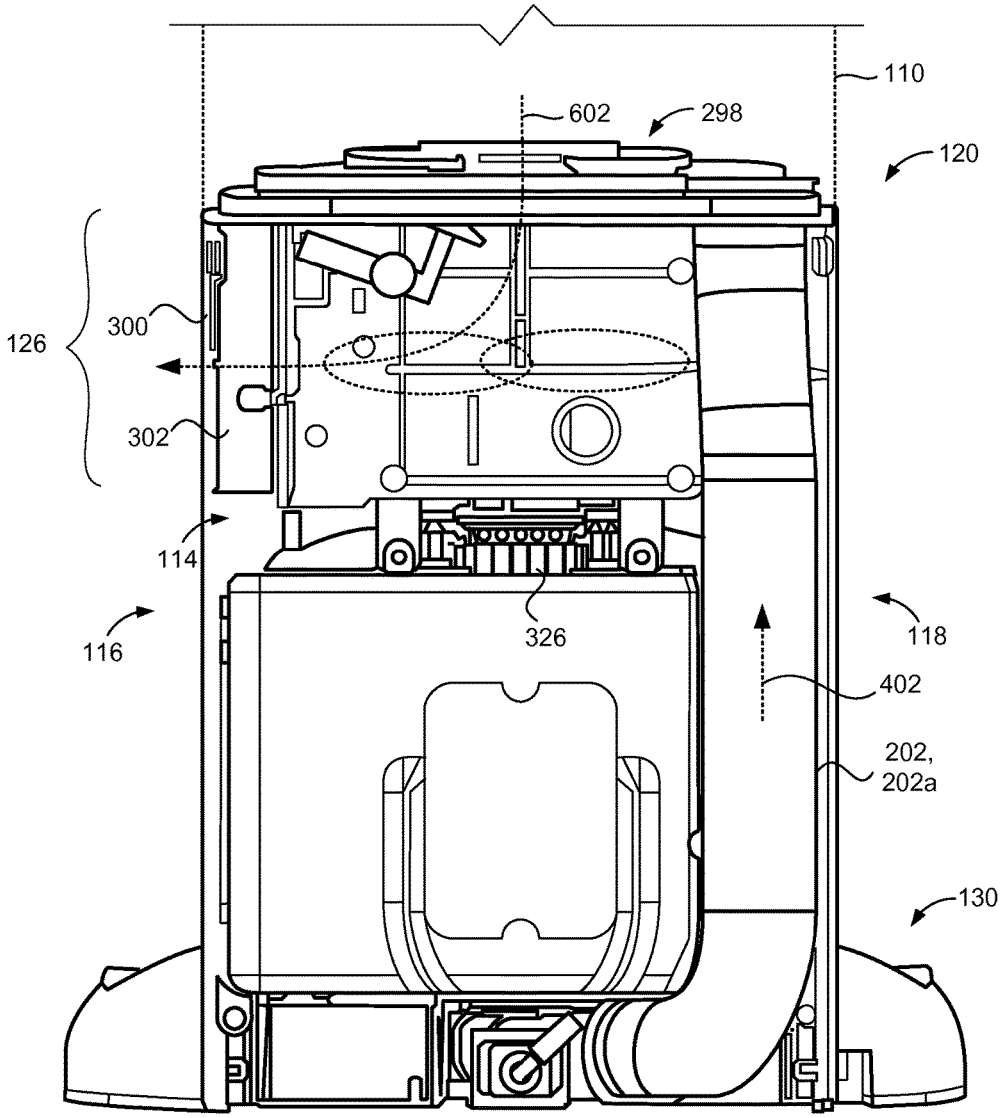
FIG. 5 is a schematic view of an example base of an evacuation station.

Referring to FIGS. 4 and 5, in some implementations, the base 120 includes the air mover 126 having the inlet 298 and the exhaust 300. The air mover moves air received from the inlet out the exhaust 300. The air mover 126 may include a motor and fan or impeller assembly 326 for powering the air mover 126. In some implementations, the base 120 houses a particle filter 302 pneumatically connected to the exhaust 300 of the air mover 126. The particle filter 302 removes small particles (e.g., between about 0.1 and about 0.5 micrometers) from air received at the inlet 298 and out the exhaust 300 of the air mover 126. The particle filter 302 may also remove small particles (e.g., between 0.1 and about 0.5 micrometers) from environmental air received at an environmental air inlet 1230 of the air mover 126 and out the exhaust 300 of the air mover 126. In some examples, the particle filter 302 is a high-efficiency particulate air (HEPA) filter. The particle filter 302 may also be referred to as the HEPA filter and/or an air filter. The particle filter 302 is disposable in some examples, and in other examples, the particle filter is washable to remove any small particles collected thereon.

As shown in FIG. 5, the base 120 encloses the air mover 126 to draw a flow of air (e.g., air-debris flow 402) from the debris bin 50 when the robotic cleaner 10 is in the docked position and the canister 110 is attached to the base 120. The first conduit portion 202*a* of the pneumatic debris intake conduit 202 transmits the air-debris flow 402 containing debris from the debris bin 50 to a second conduit portion 202*b* of the pneumatic debris intake conduit 202 enclosed within the canister 110. The second conduit portion 202*b* is arranged to pneumatically interface with the first conduit portion 202*a* to form the pneumatic debris intake conduit 202 when the canister 110 is attached to the base 120. Accordingly, the pneumatic debris intake conduit 202 corresponds to a single, pneumatic conduit for transporting the air-debris flow 402 that includes an air flow containing the debris drawn from the debris bin 50 of the robotic cleaner 10 through the collection and evacuation intake openings 40, 200, respectively.

Figure 6:
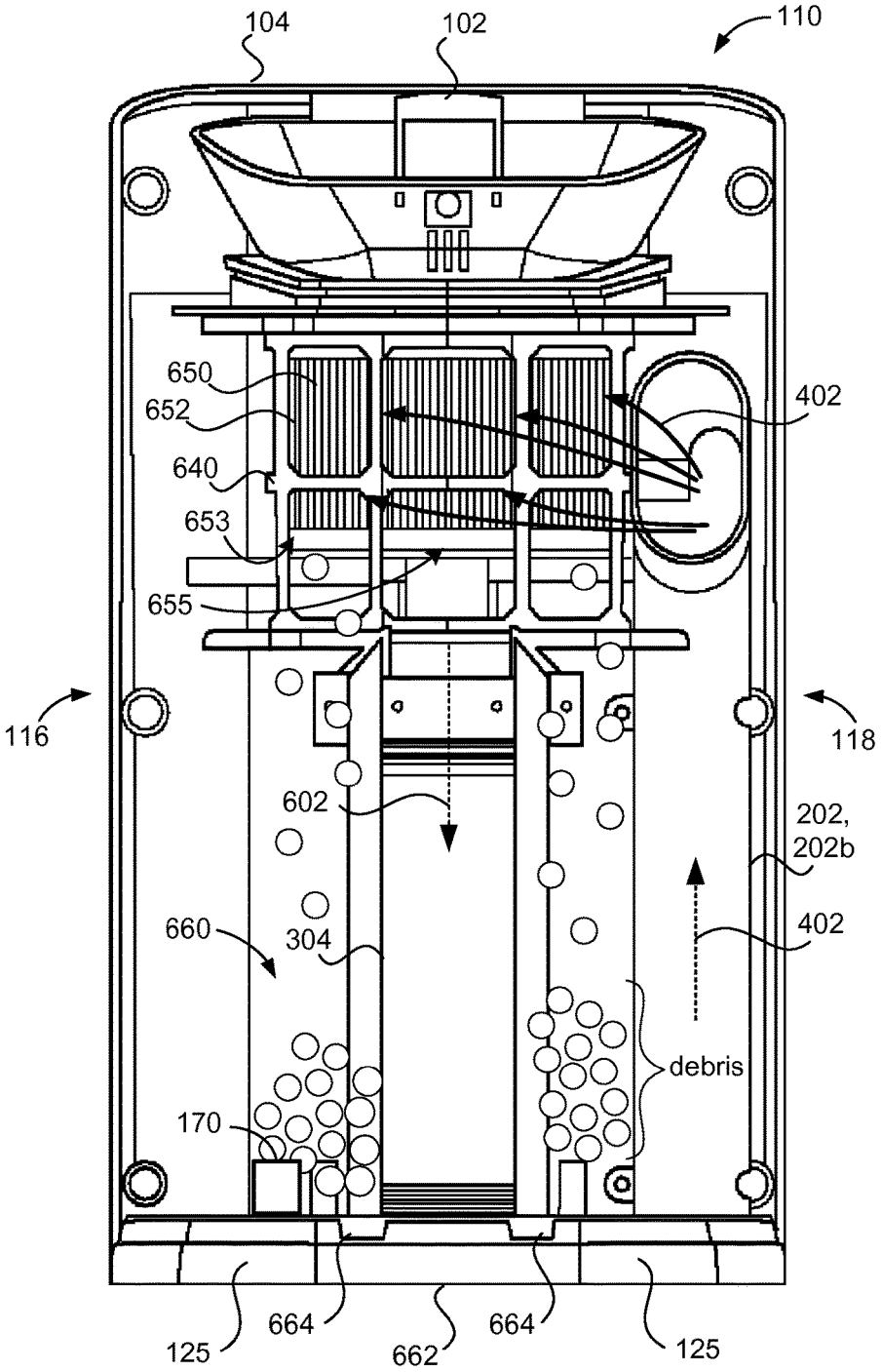
FIG. 6 is a schematic view of an example canister of an evacuation station enclosing a filter.

Referring to FIG. 6, the canister 110 includes the second conduit portion 202*b* arranged to pneumatically interface with the first conduit portion 202*a* to form the pneumatic debris intake conduit 202 when the canister 110 is attached to the base 120. In some implementations, the canister 110 includes an annular filter wall 650 in pneumatic communication with the second conduit portion 202*b*. The filter wall 650 may be corrugated to offer relatively greater surface area than a smooth circular wall. In some examples, the annular filter wall 650 is enclosed by a pre-filter cage 640 within the canister 110. The annular filter wall 650 defines an open center region 655 enclosed by an outer wall region 652. Accordingly, the annular filter wall 650 includes an annular ring-shaped cross section. The annular filter wall 650 corresponds to a separator that separates and/or filters debris out of the air-debris flow 402 received from the pneumatic debris intake conduit 202. For example, the air mover 126 draws the air-debris flow 402 through the pneumatic debris intake conduit 202 and the annular filter wall 650 is arranged within the canister 110 to receive the air-debris flow 402 exiting the pneumatic debris intake conduit 202 at the second conduit portion 202*b*. In the example shown, the annular filter wall 650 collects debris from the air-debris flow 402 received from the pneumatic debris intake conduit 202, permitting the debris-free air flow 602 to travel through the open center region 655 to the exhaust conduit 304 arranged to pneumatically connect to the inlet 298 of the air mover 126 when the canister 110 attaches to the base 120. In some examples, the HEPA filter 302 removes any small particles (e.g., ~0.1 to ~0.5 micrometers) prior to the air exiting out to the environment at the exhaust 300. A portion of the debris collected by the annular filter wall 650 may be embedded upon the filter wall 650 while another portion of the debris may fall into a debris collection bin 660 within the canister 110.

The air-debris flow 402 may be at least partially restricted from freely passing through the outer wall region 652 of the annular filter wall 650 to the open center region 655 when debris embedded upon the filter wall 650 increases. Maintenance may be performed periodically to dislodge debris from the filter wall 650 or to replace the filter wall 650 after extended use. In some examples, the annular filter wall 650 may be accessed by opening the filter access door 104 to inspect and/or replace the annular filter wall 650 as needed. For instance, the filter access door 104 may open by depressing the filter access door button 102*b* located proximate the handle 102.

The debris collection bin 660 defines a volumetric space for storing accumulated debris that falls by gravity after the annular filter wall 650 separates the debris from the air-debris flow 304. As the debris collection bin 660 becomes full of debris indicating a canister full condition, the flow of air (e.g., the air-debris flow 402 and/or the debris-free air flow 602) within the canister 110 may be restricted from flowing freely. In some implementations, one or more capacity sensors 170 located within the collection bin 660 or the exhaust conduit 304 are utilized to detect the canister full condition, indicating that debris should be emptied from the canister 110. In some examples, the capacity sensors 170 include light emitters/detectors arranged to detect when the debris has accumulated to a threshold level within the debris collection bin 660 indicative of the canister full condition. As the debris accumulates within the debris collection bin 660 and reaches the canister full condition, the debris at least partially blocks the air flow causing a pressure drop within the canister 110 and velocity of the flow of air to decrease. In some examples, the capacity sensors 170 include pressure sensors to monitor pressure within the canister 110 and detect the canister full condition when a threshold pressure drop occurs. In some examples, the capacity sensors 170 include velocity sensors to monitor air flow velocity within the canister 110 and detect the canister full condition when the air flow velocity falls below a threshold velocity. In other examples, the capacity sensors 170 are ultrasonic sensors whose signal changes according to the increase in density of debris within the canister so that a bin full signal only issues when the debris is compacted in the bin. This prevents light, fluffy debris stretching from top to bottom from triggering a bin full condition when much more volume is available for debris collection within the canister 110. In some implementations, the ultrasonic capacity sensors 170 are located between the vertical middle and top of the canister 110 rather than along the lower half of the canister so the signal received is not affected by debris compacting in the bottom of the canister 110. When the debris collection bin 660 is full (e.g., the canister full condition is detected), the canister 110 may be removed from the base 120 and the debris ejection door 662 may be opened to empty the debris into a trash receptacle. In some examples, the debris ejection door 662 opens when the debris ejection door button 102*a* proximate the handle 102 is depressed, causing the debris ejection door 662 to swing about hinges 664 to permit the debris to empty. This one button press debris ejection technique allows a user to empty the canister 110 into a trash receptacle without having to touch the debris or any dirty surface of the canister 110 to open or close the debris ejection door 662.

Figure 7:
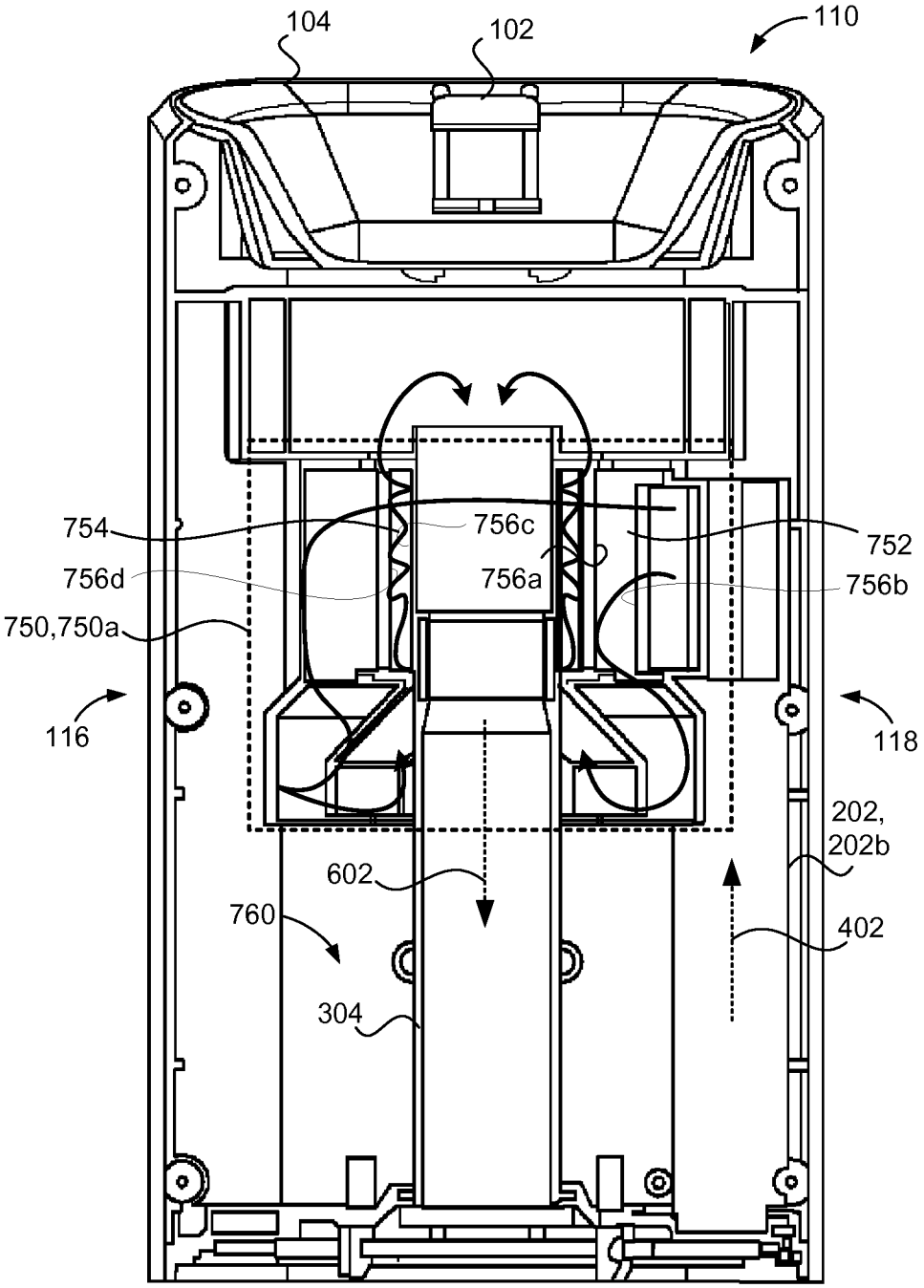
FIG. 7 is a schematic view of an example canister of an evacuation station enclosing an air particle separator device.

Referring to FIGS. 7-9B, in some implementations, the canister 110 encloses an air particle separator device 750 (also referred to as a separator) defining at least one collision wall 756*a-h* and channels arranged to direct the air-debris flow 402 received from the pneumatic debris intake conduit 202 toward the at least one collision wall 756*a-d* to separate debris out of the air-debris flow 402. FIG. 7 illustrates an example air particle separator device 750*a* including collision walls 756*a-b* defining a first-stage channel 752 and collision walls 756*c-d* defining a second-stage channel 754. In the example shown, the first-stage channel 752 receives the air-debris flow 402 from the second conduit portion 202*b* of the pneumatic debris intake conduit 202 and directs the flow 402 by centrifugal force toward collision walls 756*a-b* of the channel 752, causing coarse debris to separate and collect within a collection bin 760. The flow of air from the first-stage channel 752 is received by the second-stage channel 754. The second-stage channel 754 directs the flow 402 upward toward collision walls 756*c-d* defining the channel 754, causing fine debris to separate and collect within the collection bin 760. The air mover 126 draws the debris-free air flow 602 through the exhaust conduit 304 and to the inlet 298 and out the exhaust 300. In some examples, small particles (e.g., ~0.1 to ~0.5 micrometers) within the debris-free air flow 602 are removed by the HEPA filter 302 prior to exiting out the exhaust 300 to the environment.

Figure 8A:
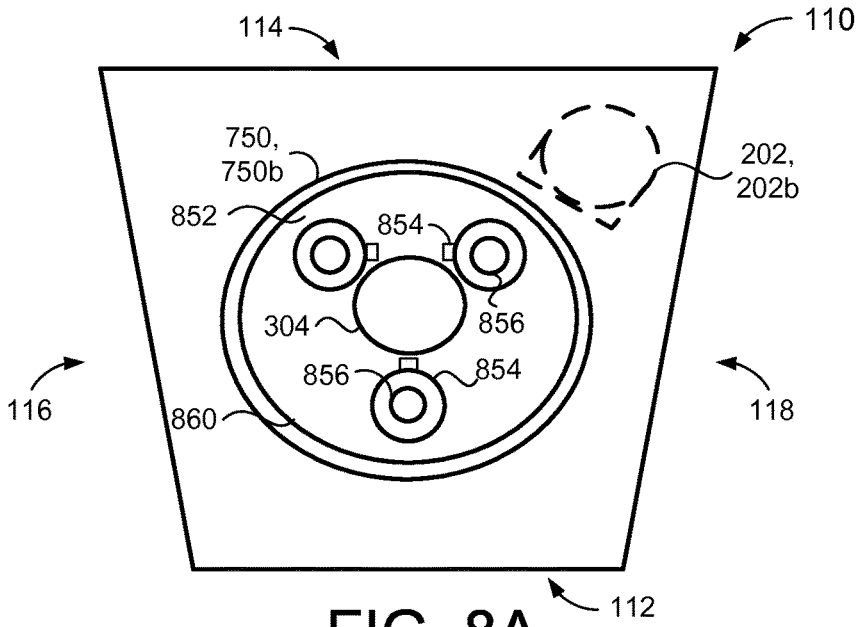
FIG. 8A is a schematic top view of an example canister of an evacuation station enclosing a filter and an air particle separator device.
Figure 8B:
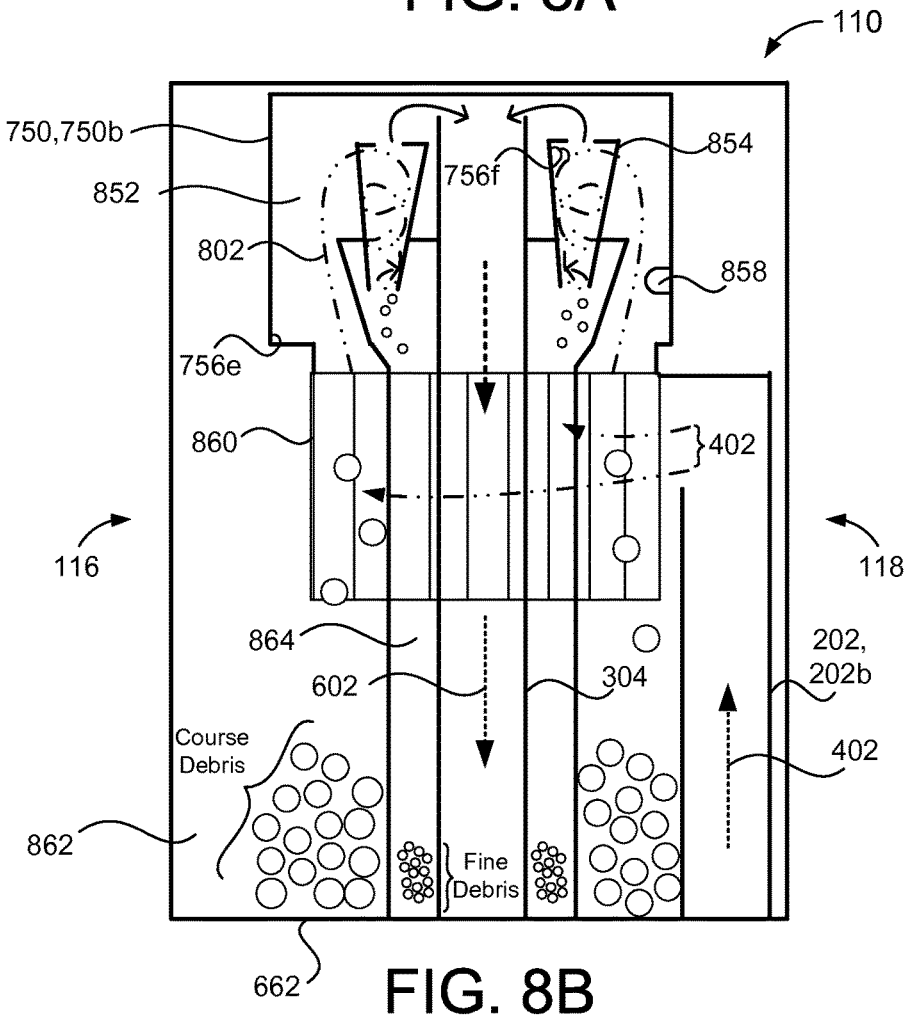
FIG. 8B is a schematic side view of an example canister of an evacuation station enclosing a filter and an air particle separator device.

Referring to FIGS. 8A and 8B, in some implementations, the canister 110 encloses an annular filter wall 860 in pneumatic communication with an air-particle separator device 750*b* for filtering and separating debris from the air-debris flow 402 received from the pneumatic debris intake conduit 202 during two stages of particle separation. FIG. 8A illustrates a top view of the canister 110, while FIG. 8B illustrates a front view of the canister 110. In the example shown, the canister 110 includes a trapezoidal cross section allowing the canister 110 to rest flush against a wall in the environment to aesthetically enhance the appearance of the evacuation station 100; however, the canister 110 may be cylindrical with a circular cross section without limitation in other examples. Internal walls of the canister 110 and/or air-particle separator device 750*b* may include ribs 858 for directing air flow. For example, ribs may be disposed upon interior walls of the canister 110 in an orientation that directs debris separated by the filter 860 and/or air-particle separator device 750*b* to fall away from the exhaust conduit 304 to prevent debris from being received by the inlet 298 of the air mover 126 and clogging the HEPA filter 302. The air flow through the exhaust 300 may be restricted if the HEPA filter 302 becomes clogged with debris. The filter 860 may include the annular filter wall 650 defining the open center region 655, as described above with reference to FIG. 6. The air-particle separator device 750*b* may include collision walls 756*e-f* defining a separator bin 852 in pneumatic communication with the open center region of the filter 860 and one or more conical separators 854.

In the example shown, the combination of the annular filter wall 860 and the air-particle separator device 750*b* provides debris to be removed from the air-debris flow 402 during two-stages of air particle separation. During the first stage, the filter 860 is arranged to receive the air-debris flow 402 from the pneumatic debris intake conduit 202. The filter 860 separates and collects coarse debris from the received air-debris flow 402. The coarse debris removed by the filter 860 may accumulate within a coarse debris collection bin 862 and/or embed upon the filter 860. Subsequently, the second stage of debris removal commences when the air passes through the filter 860 wall and into the separator bin 852 defined by collision wall 756*e*. The air entering the separator bin 852 may be referred to as a second-stage air flow 802. In the example shown, three conical separators 854 are enclosed within the separator bin 852; however, the air-particle separator device 750*b* may include any number of conical separators 854. Each conical separator 854 includes an inlet 856 for receiving the second-stage air flow 802 within the separator bin 852. The conical separators 854 include collision walls 756*f* that angle toward each other to create a funnel (e.g., channel) that causes centrifugal force acting upon the second-stage air flow 802 to increase. The increasing centrifugal force causes the second-stage air flow 802 to spin the debris toward collision walls 756*f* of the conical separators 854, causing fine debris (e.g., dust) to separate and collect within a fine debris collection bin 864. When the collection bins 862, 864 are full, the canister 110 may be removed from the base 120 and the debris ejection door 662 may be opened to empty the debris into a trash receptacle. In some examples, a user may open the debris ejection door 662 by depressing the debris ejection door button 102*a* proximate the handle 102, causing the debris ejection door 662 to swing about hinges 664 to permit the debris to empty from the collection bins 862 and 864. This one button press debris ejection technique allows a user to empty the canister 110 into a trash receptacle without having to touch the debris or any dirty surface of the canister 110 to open or close the debris ejection door 662. The air mover 126 draws the debris-free air flow 602 from the canister 110 via the exhaust conduit 304 to the inlet 298 and out the exhaust 300. In some examples, small particles (e.g., 0.1 to 0.5 micrometers) within the debris-free air flow 602 are removed by the HEPA filter 302 prior to exiting out the exhaust 300 to the environment.

Figure 9A:
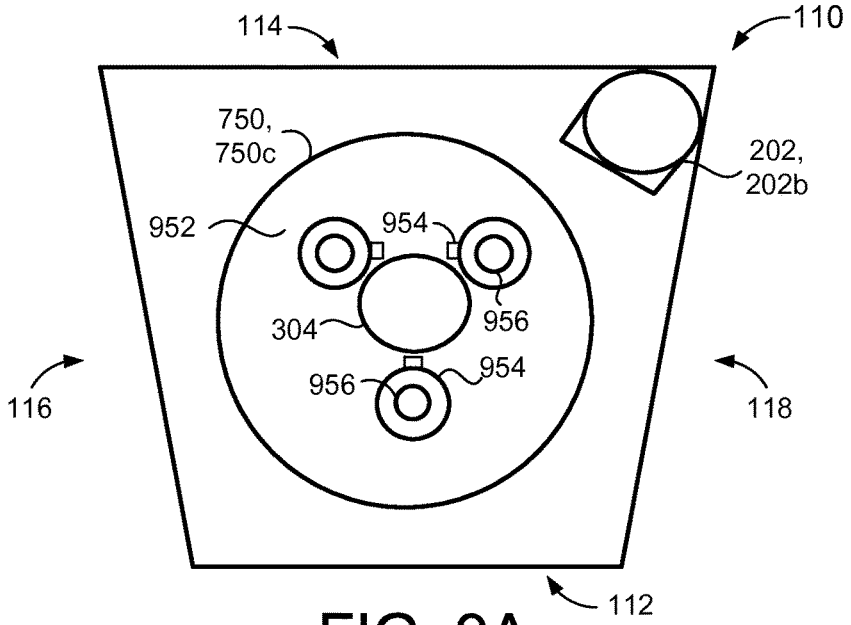
FIG. 9A is a schematic top view of an example canister of an evacuation station enclosing a two-stage air separator device.
Figure 9B:
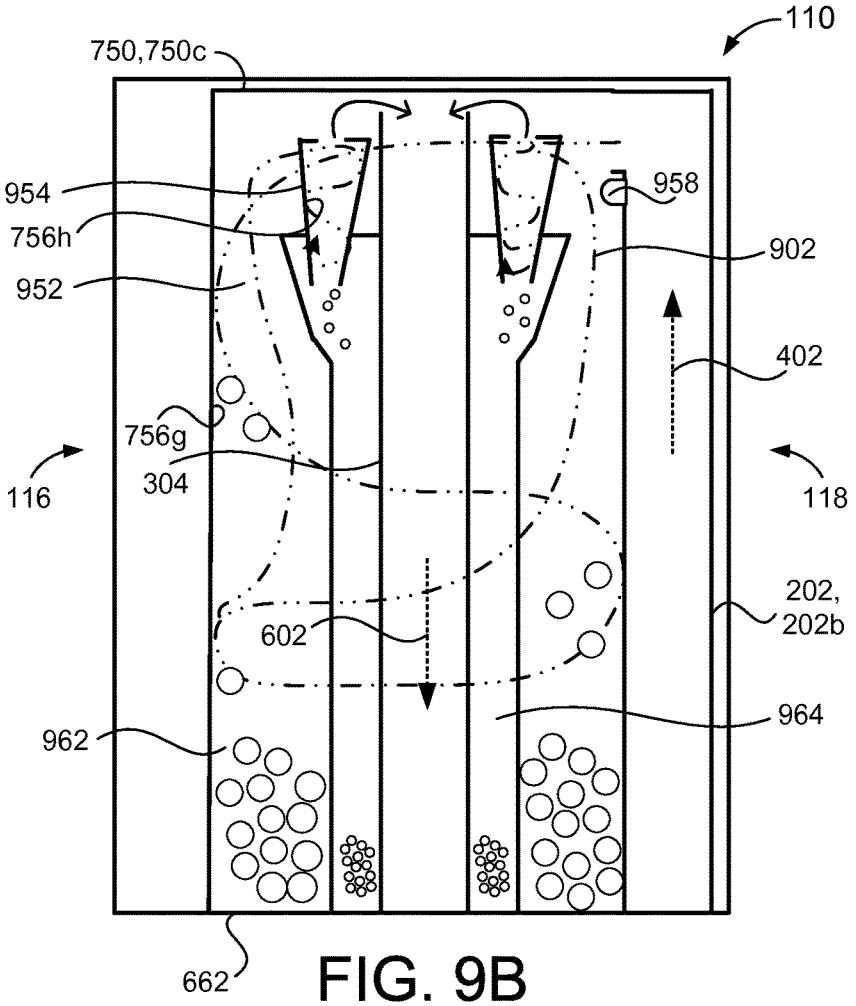
FIG. 9B is a schematic side view of an example canister of an evacuation station enclosing a two-stage air separator device.

In some examples, coarse and fine debris are separated during two stages of air particle separation using an air-particle separator device 750*c* (FIGS. 9A and 9B) without the use of the filter 860 (shown in FIGS. 8A and 8B). Referring to FIGS. 9A and 9B, the air-particle separator device 750*c* is arranged in the canister 110 to receive the air-debris flow 402 from the pneumatic debris intake conduit 202. FIG. 9A illustrates a top view of the canister 110, while FIG. 9B illustrates a front view of the canister 110. In the example shown, the canister 110 includes a trapezoidal cross section allowing the canister 110 to rest flush against a wall in the environment to aesthetically enhance the appearance of the evacuation station 100; however, the canister 110 may include a rectangular, polygonal, circular, or other cross section without limitation in other examples. Ribs 958 may be included upon interior walls of the canister 110 and/or air-particle separator device 750*c* to facilitate air flow. For example, ribs 958 may be disposed upon interior walls of the canister 110 and/or air-particle separator device 750*c* in an orientation that directs debris separated by the air-particle separator device 750*c* to fall away from the exhaust conduit 304 to prevent debris from being received by the inlet 298 of the air mover 126 and clogging the HEPA filter 302. The air flow through the exhaust 300 may be restricted if the HEPA filter 302 becomes clogged with debris.

The air-particle separator device 750*c* includes one or more collision walls 756*g-h* defining a first-stage separator bin 952 and one or more conical separators 954. In the example shown, the separator bin 952 includes a substantially cylindrical shape having a circular cross section. In other examples, the separator bin 952 includes a rectangular, polygonal, or other cross section. During the first stage of air particle separation, the first-stage separator bin 952 receives the air-debris flow 402 from the pneumatic debris intake conduit 202, wherein the separator bin 952 is arranged to channel the air-debris flow 402 toward the collision wall 756*g*, causing coarse debris to separate and collect within a coarse collection bin 962. The conical separators 954, in pneumatic communication with the separator bin 952, receive a second-stage air flow 902 referring to an air flow with coarse debris being removed at associated inlets 956. In the example shown, three conical separators 954 are enclosed within the first-stage separator bin 952; however, the air-particle separator device 750*c* may include any number of conical separators 954. The conical separators 954 include collision walls 756*h* that angle toward each other to create a funnel that causes centrifugal force acting upon the second-stage air flow 902 to increase. The increasing centrifugal force directs the second-stage air flow 902 toward the one or more collision walls 756*h*, causing fine debris (e.g., dust) to separate and accumulate within a fine debris collection bin 964. When the collection bins 962, 964 are full, the canister 110 may be removed from the base 120 and the debris ejection door 662 may be opened to empty the debris into a trash receptacle. In some examples, a user may open the debris ejection door 662 by depressing the debris ejection door button 102*a* proximate the handle 102, causing the debris ejection door 662 to swing about hinges 664 to permit the debris to empty from the collection bins 962 and 964. The air mover 126 draws the debris-free air flow 602 from the canister 110 via the exhaust conduit 304 to the inlet 298 and out the exhaust 300. In some examples, small particles (e.g., 0.1 to 0.5 micrometers) within the debris-free air flow 602 are removed by the HEPA filter 302 prior to exiting out the exhaust 300 to the environment.

Figure 10A:
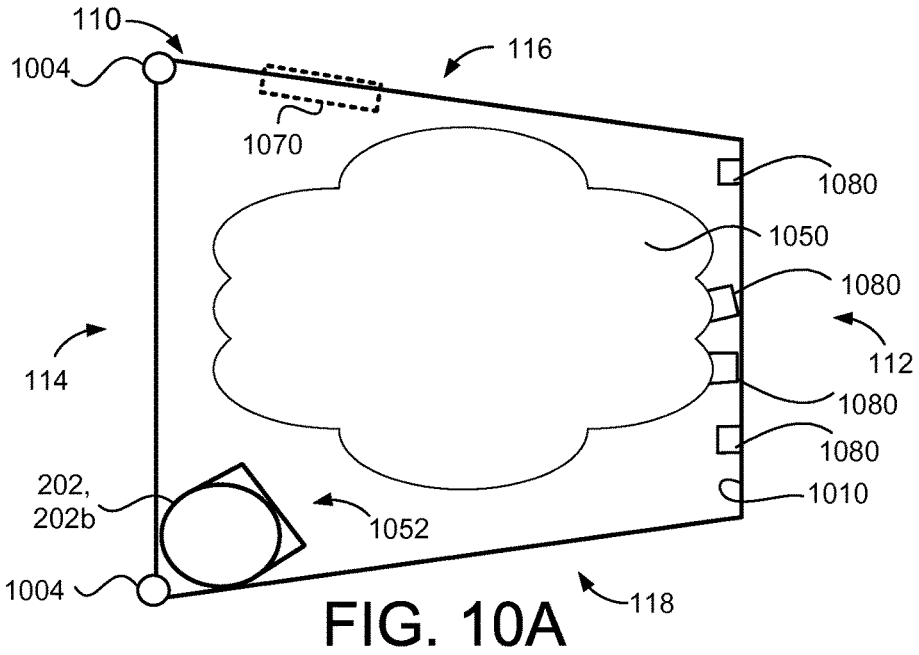
FIG. 10A is a schematic top view of an example canister of an evacuation station enclosing a filter bag.
Figure 10B:
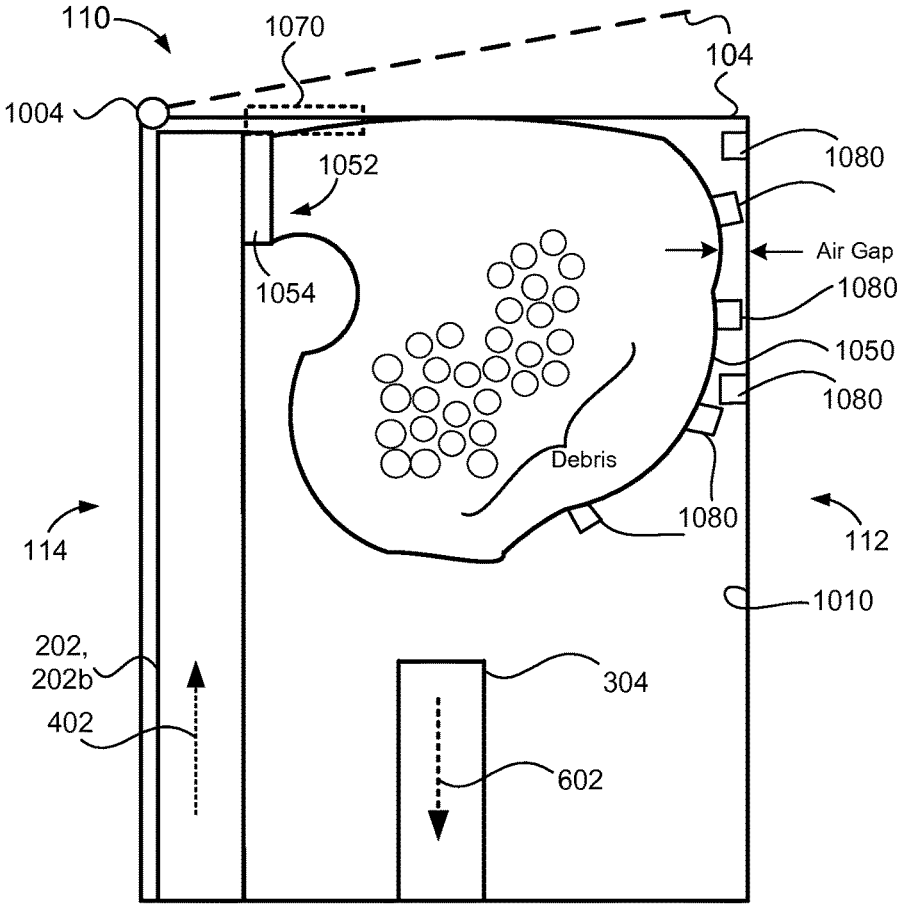
FIG. 10B is a schematic side view of an example canister of an evacuation station enclosing a filter bag.

Referring to FIGS. 10A and 10B, in some implementations, the canister 110 includes a filter bag 1050 arranged to receive the air-debris flow 402 from the pneumatic debris intake conduit 202. The filter bag 1050 corresponds to a separator that separates and filters debris out of the air-debris flow 402 received from the pneumatic debris intake conduit 202. The filter bag 1050 can be disposable and formed of paper or fabric that allows air to pass through but traps dirt and debris. FIG. 10A shows a top view of the canister 110, and FIG. 10B shows a side view of the canister 110. The filter bag 1050, while collecting debris via filtration, is porous to permit a debris-free air flow 602 to exit the filter bag 1050 via the exhaust conduit 304. Accordingly, the debris-free air flow 602 is received by the inlet 298 of the air mover 126 and out the exhaust 300. In some examples, small particles (~0.1 to ~0.5 micrometers) within the debris-free air flow 602 are removed by the HEPA filter 302 (FIG. 5) disposed in the base 120 prior to exiting out the exhaust 300 (FIG. 5).

The filter bag 1050 may include an inlet opening 1052 for receiving the air-debris flow 402 from the pneumatic debris intake conduit 202 exiting from the second conduit portion 202*b*. A fitting 1054 may be used to attach the inlet opening 1052 of the filter bag 1050 to an outlet of the second conduit portion 202*b* of the pneumatic air-debris intake conduit 202. In some implementations, the fitting 1054 includes features that poka-yoke mating the filter bag 1050 so that the bag only mates to the fitting 1054 in a proper orientation for use and expansion within the canister 110. The filter bag 1050 includes a matching interface with features accommodating those on the fitting 1054. In some examples, the filter bag 1050 is disposable, requiring replacement when the filter bag 1050 becomes full. In other examples, the filter bag 1050 may be removed from the canister 110 and collected debris may be emptied from the filter bag 1050.

The filter bag 1050 may be accessed for inspection, maintenance and/or replacement by opening the filter access door 104. For example, the filter access door 104 swings about hinges 1004. In some examples, the filter access door 104 is opened by depressing the filter access door button 102*b* located proximate the handle 102. The filter bag 1050 may provide varying degrees of filtration (e.g., ~0.1 microns to ~1 microns). In some examples, the filter bag 1050 includes HEPA filtration in addition to, or instead of, the HEPA filter 302 located proximate the exhaust 300 within the base 120 of the evacuation station 100.

In some implementations, the canister 110 includes a filter bag detection device 1070 configured to detect whether or not the filter bag 1050 is present. For example, the filter bag detection device 1070 may include light emitters and detectors configured to detect the presence of the filter bag 1050. The filter bag detection device 1070 may relay signals to the controller 1300. In some examples, when the filter bag detection device 1070 detects the filter bag 1050 is not within the canister 110, the filter detection device 1070 prevents the filter access door 104 from closing. For example, the controller 1300 may activate mechanical features or latches proximate the canister 110 and/or filter access door 104 to prevent the filter access door 104 from closing. In other examples, the filter bag detection device 1070 is mechanical and movable between a first position for preventing the filter access door 104 from closing and a second position for allowing the filter access door 104 to close. In some examples, a fitting 1054 swings or moves upward when the filter bag 1050 is removed and prevents the filter door 104 from closing. The fitting 1054 is depressed upon insertion of the filter bag 1050 allowing the filter door 104 to close. In some examples, detecting when the filter bag 1050 is not present in the canister 110 prevents the evacuation station 100 from operating in the evacuation mode, even if the robotic cleaner 10 is received at the ramp 130 in the docked position. For instance, if the evacuation station 100 were to operate in the evacuation mode when the filter bag 1050 is not present, debris contained in the air-debris flow 402 may become dislodged within the canister 110, exhaust conduit 304, and/or air mover 126, restricting the flow of air to the exhaust 300 as well as causing damage to the motor and fan or impeller assembly 326 (FIG. 5).

Referring to FIG. 10A, in some implementations, the canister 110 includes a trapezoidal cross section allowing the canister 110 to rest flush against a wall in the environment to aesthetically enhance the appearance of the evacuation station 100. The canister 110 may however, include a rectangular, polygonal, circular, or other cross section without limitation in other examples. The filter bag 1050 expands as the collected debris accumulates therein. Expansion of the filter bag 1050 into contact with interior walls 1010 of the canister 110 may result in debris only accumulating at a bottom portion of the filter bag 1050, thereby choking the air flow through the filter bag 1050. In some implementations, the filter bag 1050 and/or interior walls 1010 of the canister 110 include protrusions 1080, such as ribs, edges or ridges, disposed upon and extending away from the exterior surface of the filter bag 1050 and/or extending into the canister 110 from the interior walls 1010. As the filter bag 1050 expands, the protrusions 1080 on the bag 1050 abut against the interior walls 1010 of the canister 110 to prevent the filter bag 1050 from fully expanding into the interior walls 1010. Similarly, when the protrusions 1080 are disposed on the interior walls 1010, the protrusions 1080 restrict the bag 1050 from fully expanding into flush contact with the interior walls 1010. Accordingly, the protrusions 1080 ensure that an air gap is maintained between the filter bag 1050 and the interior walls 1010, such that the filter bag 1050 cannot fully expand into contact the interior walls 1010. In some examples, the protrusions 1080 are elongated ribs uniformly spaced in parallel around the exterior surface of the filter bag 1050 and/or the surface of the interior walls 1010. The spacing between adjacent protrusions 1080 is small enough to prevent the filter bag 1050 from bowing out and into contact with the interior walls. In some implementations, the canister 110 is cylindrical and the protrusions 1080 are elongated ribs that run vertically down the length of the canister 110 and around the entire circumference of the canister 110 such that airflow continues to be uniform through the entire surface of the unfilled portion of bag even as debris compacts in the bottom of the bag.

Figure 11:
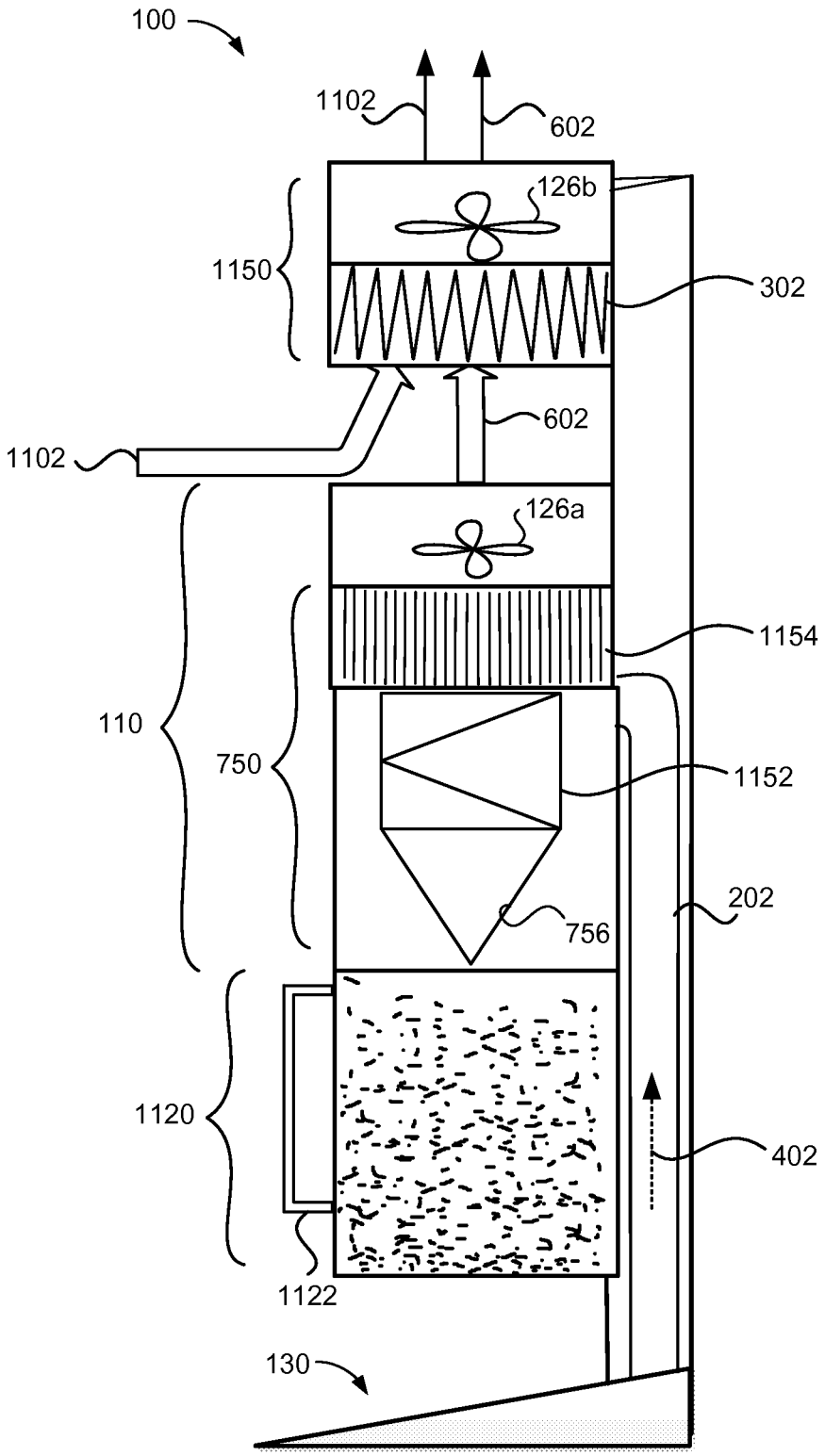
FIG. 11 is a schematic view of an example evacuation station.

FIG. 11 shows a schematic view of an example evacuation station 100 including an air particle separator device 750 and an air filtration device 1150. The evacuation station 100 includes a base 120, a collection bin 1120 and a ramp 130 for docking with the autonomic robotic cleaner 10. The example robotic cleaner 10 docking with the ramp 130 is described above with reference to FIGS. 1-5; however, other types of robots 10 are possible as well. In the example shown, the base 120 houses a first air mover 126*a* (e.g. a motor driven vacuum impeller) and the air particle separator device 750. When the robot 10 is in the docked position, the first air mover 126*a* draws an air-debris flow 402 through a pneumatic debris intake conduit 202 to pull debris from within the debris bin 50 of the robotic 10. The pneumatic debris intake conduit 202 provides the air-debris flow 402 from the debris bin 50 to a single stage particle separator 1152 of the air particle separator device 750. The centrifugal force created by the geometry of the single stage particle separator 1152 causes the air-debris flow 402 to direct toward one or more collision walls 756 of the separator 1152, causing particles to fall from the drawn air 402 and collect in the collection bin 1120 disposed beneath the single stage particle separator 1152. A filter 1154 may be disposed above the single stage particle separator 1152 to prevent debris from being drawn up and through the first air mover 126*a* and damaging the first air mover 126*a*.

A second air mover 126*b* of the air filtration device 1150 provides suction and draws the debris-free air flow 602 from the air mover 126*a* through and into the air filtration device 1150. In some examples, the second air mover 126*b* of the air filtration device 1150 includes a fan/fin/impeller that spins. A particle filter 302 may remove small particles (e.g., ~0.1 to ~0.5 microns) from the debris-free air flow 602. In some examples, the particle filter 302 is a HEPA filter 302 as described above with reference to FIGS. 4 and 5. Upon passing through the air particle filter 302, the debris-free air flow 602 may exhaust into the environment external to the evacuation station 100.

The air filtration device 1150 may further operate as an air filter for filtering environmental air external to the evacuation station 100. For example, the second air mover 126*b* may draw the environmental air 1102 to pass through the HEPA filter 302. In some examples, the air filtration device 1150 filters the environmental air via the HEPA filter 302 when the robot 10 is not received in the docked position, and/or the debris bin 50 of the robot 10 is not being evacuated. In other examples, the air filtration device 1150 simultaneously draws environmental air 1102 and debris-free flow 602 exiting the air particle separator device 750 through the HEPA filter 302.

In some implementations, the collection bin 1120 is removably attached to the base 120. In the example shown, the collection bin 1120 includes a handle 1122 for carrying the collection bin 1120 when removed from the base 120. For instance, the collection bin 1120 may be detached from the base 120 when the handle 1122 is pulled by the user. The user may transport the collection bin 1120 via the handle 1122 to empty the collected debris when the collection bin 1120 is full. The collection bin 1120 may include a button-press actuated debris ejection door, similar to the debris ejection door 662 described above with reference to FIG. 6. This one button press debris ejection technique allows a user to empty the collection bin 1120 into a trash receptacle without having to touch the debris or any dirty surface of the collection bin 1120 to open or close the debris ejection door 662.

Figure 12B:
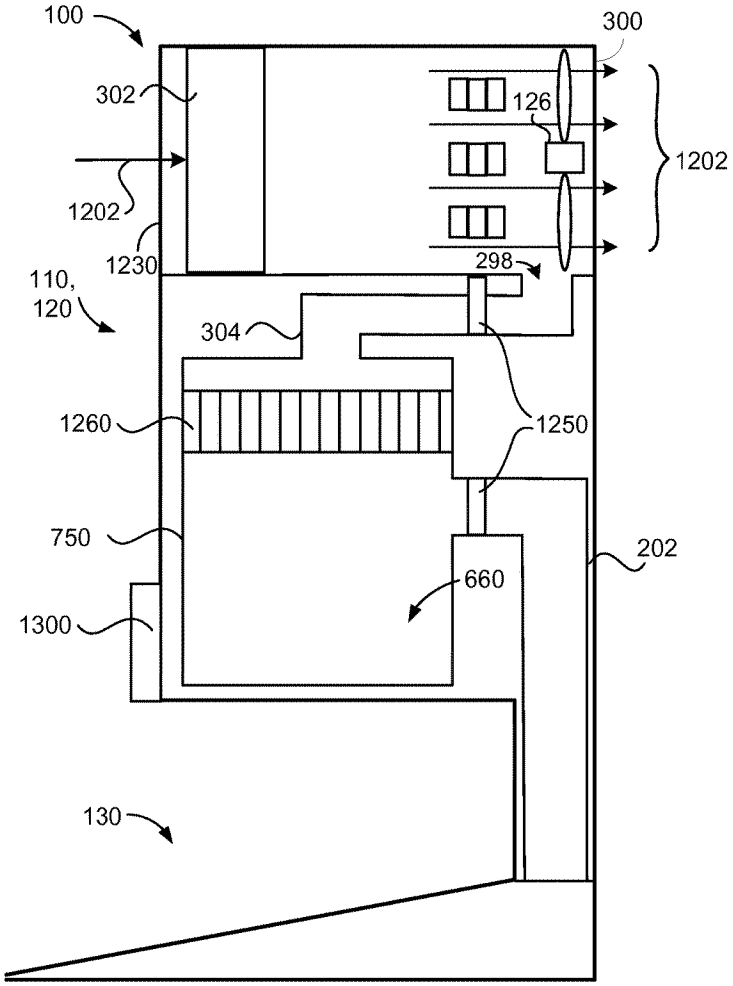
FIGS. 12A and 12B are schematic views of an example flow control device for directing air flow through an air filter.
Figure 12A:
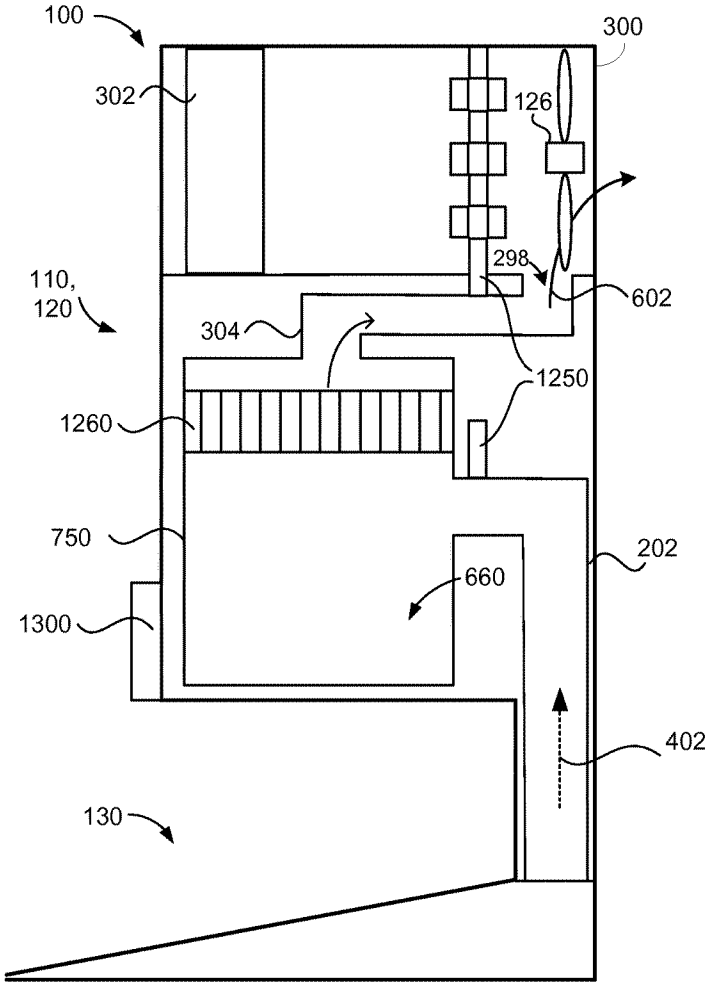

In some implementations, referring to FIGS. 12A and 12B, an example evacuation station 100 includes a flow control device 1250 in communication with a controller 1300 that selectively actuates the flow control device 1250 between a first position (FIG. 12A) when the evacuation station 100 operates in an evacuation mode and a second position (FIG. 12B) when the evacuation station 100 operates in an air filtration mode. In some examples, the flow control device 1250 is a flow control valve spring biased toward the first position or the second position. The flow control device 1250 may be actuated between the first and second positions to selectively block one air flow passage or another.

Referring to FIG. 12A, when the robotic cleaner 10 is received in the docked position at the ramp 130, the evacuation station 100 may operate in the evacuation mode to evacuate debris from the debris bin 50 of the robotic cleaner 10. During the evacuation mode, in some examples, the controller 1300 activates an air mover 126 (motor and impeller) and actuates the flow control device 1250 to the first position, pneumatically connecting the pneumatic debris intake conduit 202 to the inlet 298 of the air mover 126. An air-debris flow 402 may be drawn by the air mover 126 through the pneumatic debris intake conduit 202. The canister 110 may enclose a filter 1260 in pneumatic communication with the pneumatic debris intake conduit 202 for filtering/separating debris out of the air-debris flow 402. Additionally or alternatively, the canister 110 may enclose an air particle separator device 750 for separating the debris out of the air-debris flow 402, as discussed in the examples above. A debris collection bin 660 may store accumulated debris that fall by gravity after being separated from the air-debris flow 304 by the filter 1260. The flow control device 1250 in the first position pneumatically connects the exhaust conduit 304 to the inlet of 298 of the air mover 126. Accordingly, upon separating/filtering debris out of the air-debris flow 402, a debris-free air flow 602 may travel through the exhaust conduit 304 and into the air mover 126 and out the exhaust 300 when the flow control device 1250 is in the first position associated with the evacuation mode. The flow control device 1250, while in the first position, also blocks environmental air 1202 (FIG. 12B) from being drawn by the air mover 126 through an environmental air inlet 1230 of the air mover 126 and out the exhaust 300.

Referring to FIG. 12B, when the robotic cleaner 10 is not in the docked position or the robotic cleaner 10 is in the docked position but the evacuation station is not evacuating debris, the evacuation station 100 may operate in the air filtration mode. During the air filtration mode, in some examples, the controller 1300 activates the air mover 126 and actuates the flow control device 1250 to the second position, pneumatically connecting the environmental air inlet 1230 to the exhaust 300 of the air mover 126 while pneumatically disconnecting the inlet 298 of the air mover 126 from the exhaust conduit 304. For example, the air mover 126 may draw the environmental air 1202 via the environmental air inlet 1230 to pass through an air particle filter 302 such as a HEPA filter described above. Upon passing through the air particle filter 302 (e.g., HEPA filter) the environmental air 1202 may travel out the exhaust 300 and back into the environment. Since the flow control device 1250 in the second position pneumatically disconnects the inlet 298 from the exhaust conduit 304, no air flow is drawn by the air mover 126 through the pneumatic debris intake conduit 202 or the exhaust conduit 304.

Referring back to FIGS. 2A-2B, air flow generated within the debris bin 50 of the robot 10 during the evacuation mode allows debris in the bin 50 to be sucked out and transported to the evacuation station 100. The air flow within the debris bin 50 must be sufficient to permit the debris to be removed while avoiding damage to the bin 50 and a robot motor (not shown) housed within the bin 50. When the robotic cleaner 10 is cleaning, the robot motor may generate an air flow to draw debris from the collection opening 40 into the bin 50 to collect the debris within the bin 50, while permitting the air flow to exit the bin 50 through an exhaust vent (not shown) proximate the robot motor. The evacuation station can be used, for example, with a bin such as that disclosed in U.S. patent application Ser. No. 14/566,243, filed Dec. 10, 2014 and entitled, "DEBRIS EVACUATION FOR CLEANING ROBOTS", which is hereby incorporated by reference in its entirety.

Figure 13:
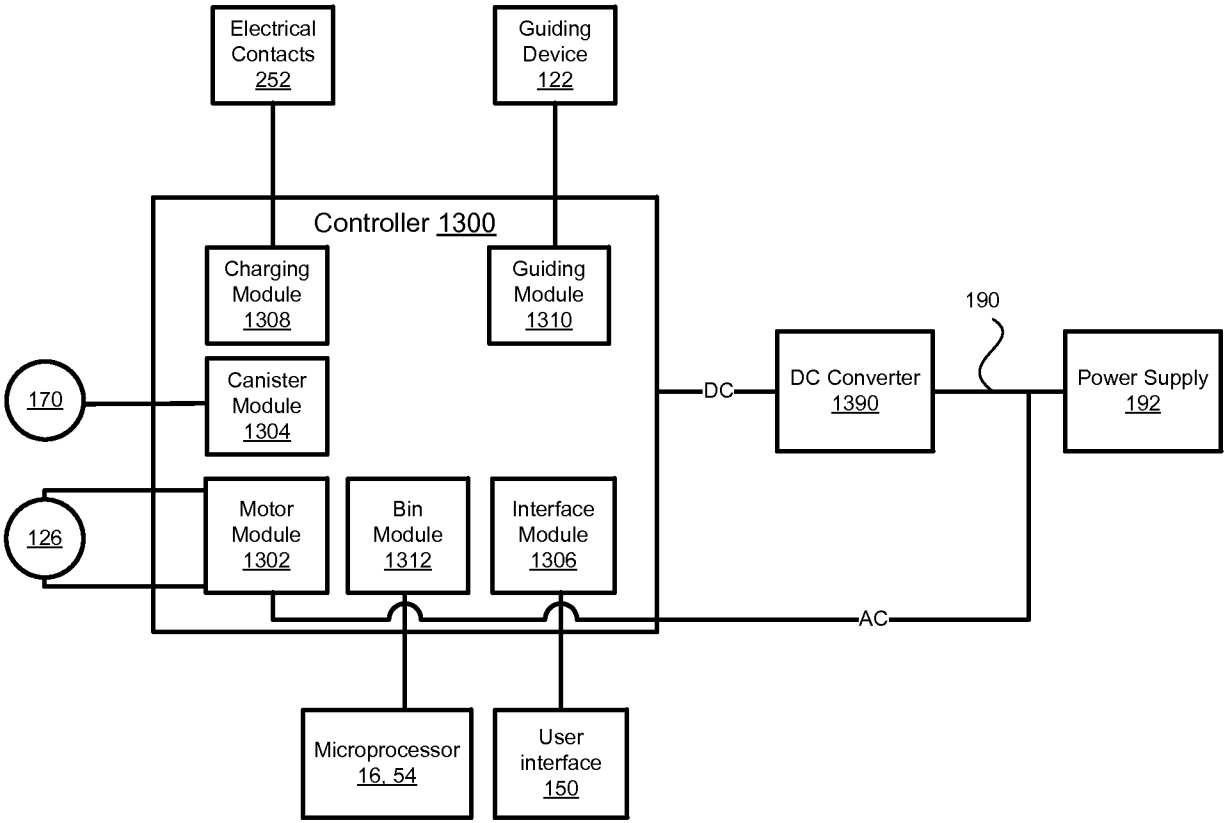
FIG. 13 is schematic view of an example controller of an evacuation station.

FIG. 13 shows an example controller 1300 enclosed within the evacuation station 100. The external power supply 192 (e.g., wall outlet) may power the controller 1300 via the power cord 190. The DC converter 1390 may convert AC current from the power supply 192 into DC current for powering the controller 1300.

The controller 1300 includes a motor module 1702 in communication with the air mover 126 using AC current from the external power supply 192. The motor module 1302 may further monitor operational parameters of the air mover 126 such as, but not limited to, rotational speed, output power, and electrical current. The motor module 1302 may activate the air mover 126. In some examples, the motor module 1302 actuates the flow control valve 1250 between the first and second positions.

In some implementations, the controller 1300 includes a canister module 1304 receiving a signal indicating a canister full condition when the canister 110 has reached its capacity for collecting debris. The canister module 1304 may receive signals from the one or more capacity sensors 170 located within the canister (e.g., collection chambers or exhaust conduit 304) and determine when the canister full condition is received. In some examples, an interface module 1306 communicates the canister full condition to the user interface 150 by displaying a message indicating the canister full condition. The canister module 1304 may receive a signal from the connection sensor 420 indicating if the canister 110 is attached to the base 120 or if the canister 110 is removed from the base 120.

In some examples, a charging module 1308 receives an indication of electrical connection between the one or more charging contacts 252 and the one or more a corresponding electrical contacts 25. The indication of electrical connection may indicate the robotic cleaner 10 is received in the docked position. The controller 1300 may execute the first operation mode (e.g., evacuation mode) when the electrical connection indication is received at the charging module 1308. The charging module 1308, in some examples, receives an indication of electrical disconnection between the one or more charging contacts 252 and the one or more a corresponding electrical contacts 25. The indication of electrical disconnection may indicate the robotic cleaner 10 is not received in the docked position. The controller 1300 may execute the second operation mode (e.g., air filtration mode) when the electrical disconnection indication is received at the charging module 1308.

The controller 1300 may detect when the charging contacts 252 located upon the ramp 130 are in contact with the electrical contacts 25 of the robotic cleaner 10. For example, the charging module 1308 may determine the robotic cleaner 10 has docked with the evacuation station 100 when the electrical contacts 25 are in contact with the charging contacts 252. The charging module 1308 may communicate the docking determination to the motor module 1302 so that the air mover 126 may be powered to commence evacuating the debris bin 50 of the robotic cleaner 10. The charging module 1308 may further monitor the charge of the battery 24 of the robotic cleaner 10 based on signals communicated between the charging and electrical contacts 25, 252, respectively. When the battery 24 needs charging, the charging module 1308 may provide a charging current for powering the battery. When the battery 24 capacity is full, or no longer needs charging, the charging module 1308 may block the supply of charging through the electrical contacts 25 of the battery 24. In some examples, the charging module 1308 provides a state of charge or estimated charge time for the battery 24 to the interface module 1306 for display upon the user interface 150.

In some implementations, the controller 1300 includes a guiding module 1310 that receives signals from the guiding device 122 (emitter 122*a* and/or detector 122*b*) located on the base 120. Based upon the signals received from the guiding device 122, the guiding module may determine when the robot 10 is received in the docked position, determine a location of the robot 10, and/or assist in guiding the robot 10 to toward the docked position. The guiding module 1310 may additionally or alternatively receive signals from sensors 232*a*, 232*b* (e.g., weight sensors) for detecting when the robot 10 is in the docked position. The guiding module 1310 may communicate to the motor module 1302 when the robot 10 is received in the docked position so that the air mover 126 can activated for drawing out debris from the debris bin 50 of the robot.

A bin module 1312 of the controller 1300 may indicate a capacity of the debris bin 50 of the robotic cleaner 10. The bin module 1312 may receive signals from the microprocessor 14 and/or 54 of the robot 10 and the capacity sensor 170 that indicate the capacity of the bin 50, e.g., the bin full condition. In some examples, the robot 10 may dock when the battery 24 is in need of charging but the bin 50 is not full of debris. For instance, the bin module 1312 may communicate to the motor module 1302 that evacuation is no longer needed. In other examples, when the bin 50 becomes evacuated of debris during evacuation, the bin module 1312 may receive a signal indicating that the bin 50 no longer requires evacuation and the motor module 1302 may be notified to deactivate the air mover 126. The bin module 1312 may receive a collection bin identification signal from the microprocessor 14 and/or 54 of the robot 10 that indicates a model type of the debris bin 50 used by the robotic cleaner 10.

In some examples, the interface module 1306 receives operational commands input by a user to the user interface 150, e.g., an evacuation schedule and/or charging schedule for evacuating and/or charging the robot 10. For instance, it may be desirable to charge and/or evacuate the robot 10 at specific times even though the bin 50 is not full and/or the battery 24 is not entirely depleted. The interface module 1306 may notify the guiding module 1310 to transmit honing signals through the guiding device 122 to call the robot 10 to dock during the time of a set charging and/or evacuation event specified by the user.

Figure 14:
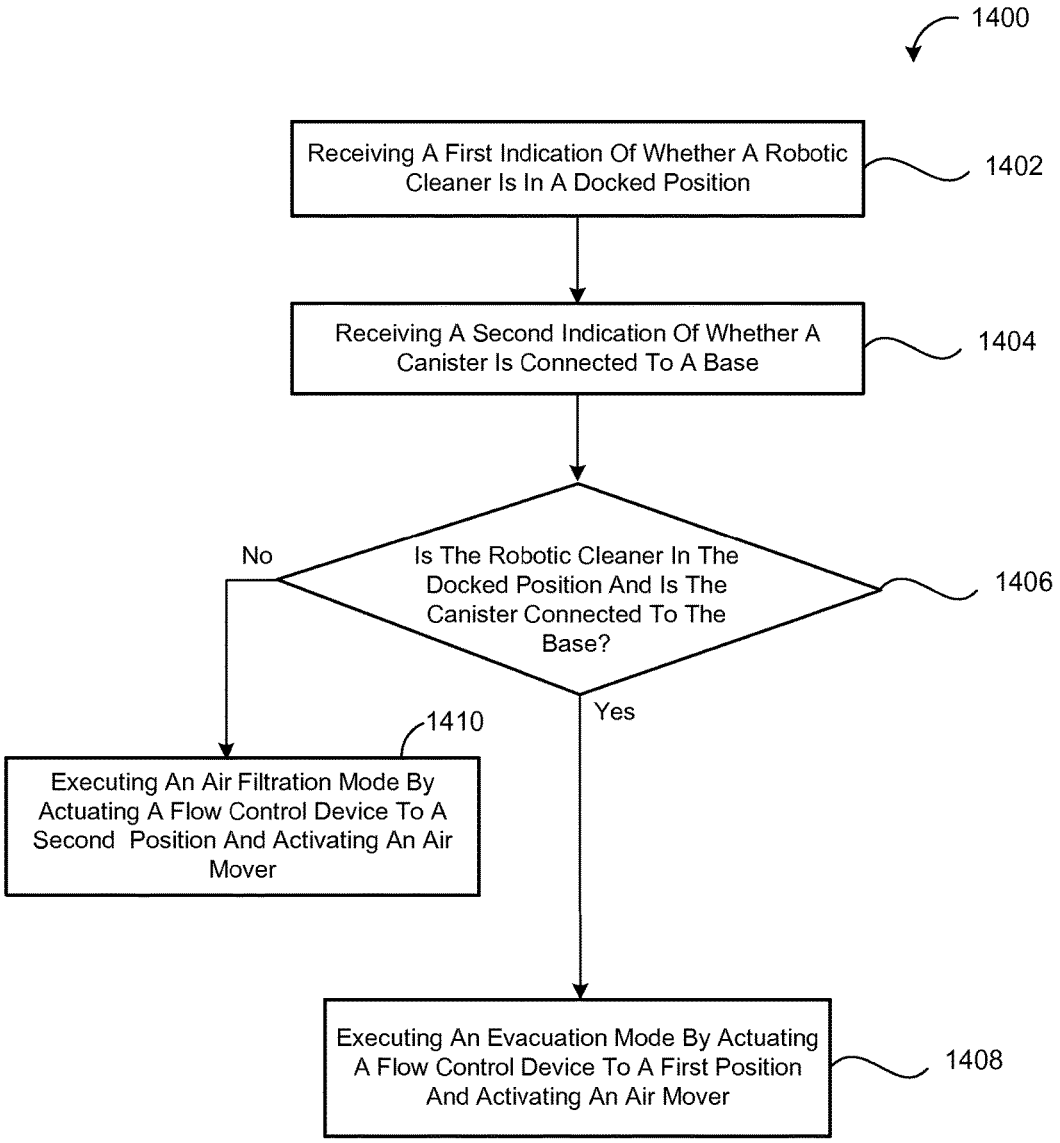
FIG. 14 is an example method for operating an evacuation station in first and second operation modes.

FIG. 14 provides an example arrangement of operations for a method 1400, executable by the controller 1300 of FIG. 13, for operating the evacuation station 100 between an evacuation mode (e.g., a first operation mode) and an air filtration mode (e.g., a second operation mode). The flowchart starts at operation 1402 where the controller 1300 receives a first indication of whether the robotic cleaner 10 is received on the receiving surface 132 in the docked position, and at operation 1404, receives a second indication of whether the canister 110 is connected to the base 120. The controller 1300 may receive the first and second indications of operations 1802, 1804, respectively, in any order or in parallel. In some examples, the first indication includes the controller 1300 receiving an electrical signal from the one or more charging contacts 252 disposed on the receiving surface 132 that interface with electrical contacts 25 when the robotic cleaner 10 is in the docked position. In some examples, the second indication includes the controller 1300 receiving a signal from the connection sensor 420 sensing connection of the canister 110 to the base 120.

At operation 1406, when the first indication indicates the robotic cleaner 10 is received on the receiving surface 132 of the ramp 130 in the docked position and the second indication indicates that the canister 110 is attached to the base 120, the controller 1300 executes the evacuation mode (first operation mode) at operation 1408 by actuating the flow control device 1250 to move to the first position (FIG. 12A) that pneumatically connects the evacuation intake opening 200 to the canister 110 and activates the air mover 126 to draw air into the evacuation intake opening 200 to draw debris from the debris bin 50 of the docked robotic cleaner 10 into the canister 110. However, when at least one of the first indication indicates the robotic cleaner 10 is not received on the receiving surface 132 in the docked position or the second indication indicates that the canister 110 is disconnected from the base 120 at operation 1406, the controller 1300, at operation 1410, executes the air filtration mode (second operation mode) by actuating the flow control valve 1250 to move to the second position (FIG. 12B) that pneumatically connects the environmental air inlet 1230 (FIGS. 12A and 12B) to the exhaust 300 of the air mover 126 while pneumatically disconnecting the inlet 298 of the air mover 126 from the exhaust conduit 304. During the air filtration mode, the air mover 126 may draw environmental air 1202 through the environmental air inlet 1230 and the particle filter 302 and out the exhaust 300. In some implementations, operation 1408 additionally detects whether or not the evacuation mode is executing or has recently stopped executing. When operation 1406 determines the evacuation mode is not executing, the controller 1300, at operation 1410, executes the air filtration mode even though the canister 110 is attached to the base 120 and the robotic cleaner 10 is received in the docked position.

While operations are depicted in the drawings in a particular order, this should not be understood as requiring that such operations be performed in the particular order shown or in sequential order, or that all illustrated operations be performed, to achieve desirable results. In certain circumstances, multi-tasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

A number of implementations have been described. Nevertheless, it will be understood that various modifications may be made without departing from the spirit and scope of the disclosure. Accordingly, other implementations are within the scope of the following claims.

What is claimed is:

1. An evacuation station comprising:

a base comprising:

a ramp having a receiving surface for receiving and supporting a robotic cleaner having a debris bin, the ramp defining an evacuation intake opening arranged to pneumatically interface with the debris bin of the robotic cleaner when the robotic cleaner is received on the receiving surface in a docked position;

a first conduit portion of a pneumatic debris intake conduit pneumatically connected to the evacuation intake opening;

an air mover having an inlet and an exhaust, the air mover moving air received from the inlet out the exhaust; and a particle filter pneumatically connected to the exhaust of the air mover; and a canister removably attached to the base, the canister comprising:

a second conduit portion of the pneumatic debris intake conduit arranged to pneumatically interface with the first conduit portion to form the pneumatic debris intake conduit when the canister is attached to the base;

a separator in pneumatic communication with the second conduit portion of the pneumatic debris intake conduit, the separator separating debris out of a received flow of air;

an exhaust conduit in pneumatic communication with the separator and arranged to pneumatically connect to the inlet of the air mover when the canister is attached to the base; and a collection bin in pneumatic communication with the separator.

2. The evacuation station of claim 1, wherein the separator defines at least one collision wall and channels arranged to direct the flow of air from the second conduit portion of the pneumatic debris intake conduit toward the at least one collision wall to separate debris out of the flow of air.

3. The evacuation station of claim 2, wherein the at least one collision wall defines a separator bin having a substantially cylindrical shape.

4. The evacuation station of claim 1, wherein the separator comprises an annular filter wall defining an open center region, the annular filter wall arranged to receive the flow of air from the second conduit portion of the pneumatic debris intake conduit to remove debris out of the flow of air.

5. The evacuation station of claim 1, wherein the separator comprises another particle filter filtering larger particles than the other particle filter.

6. The evacuation station of claim 1, wherein the separator comprises a filter bag arranged to receive the flow of air from the second conduit portion of the pneumatic debris intake conduit to remove debris out of the flow of air.

7. The evacuation station of claim 1, wherein the collection bin comprises a debris ejection door movable between a closed position for collecting debris in the collection bin and an open position for ejecting collected debris from the collection bin.

8. The evacuation station of claim 1, wherein the canister and the base have a trapezoidal shaped cross section.

9. The evacuation station of claim 1, wherein the canister and the base define a height of the evacuation station, the canister defining greater than half of the height of the evacuation station.

10. The evacuation station of claim 9, wherein the canister defines at least two-thirds of the height of the evacuation station.

11. The evacuation station of claim 1, wherein the ramp further comprises a seal pneumatically sealing the evacuation intake opening and a collection opening of the robotic cleaner when the robotic cleaner is in the docked position.

12. The evacuation station of claim 1, wherein the ramp further comprises:

one or more charging contacts disposed on the receiving surface and arranged to interface with one or more corresponding electrical contacts of the robotic cleaner when received in the docked position; and one or more alignment features disposed on the receiving surface and arranged to orient the received robotic cleaner so that the evacuation intake opening pneumatically interfaces with the debris bin of the robotic cleaner and the one or more charging contacts electrically connect to the electrical contacts of the robotic cleaner when received in the docked position.

13. The evacuation station of claim 12, wherein the one or more alignment features comprise:

wheel ramps accepting wheels of the robotic cleaner while the robotic cleaner is moving to the docked position; and wheel cradles supporting the wheels of the robotic cleaner when the robotic cleaner is in the docked position.

14. The evacuation station of claim 12, further comprising a controller in communication with the air mover and the one or more charging contacts, the controller activating the air mover to move air when the controller receives an indication of electrical connection between the one or more charging contacts and the one or more corresponding electrical contacts.

* * * * *